US011492863B2

(12) United States Patent
Southard et al.

(10) Patent No.: US 11,492,863 B2
(45) Date of Patent: Nov. 8, 2022

(54) ENHANCED GEOMETRY RECEIVING ELEMENT FOR A DOWNHOLE TOOL

(71) Applicant: Well Master Corporation, Golden, CO (US)

(72) Inventors: Matthew J. Southard, Denver, CO (US); Daniel J. Nelson, Littleton, CO (US)

(73) Assignee: Well Master Corporation, Golden, CO (US)

( * ) Notice: Subject to any disclaimer, the term of this patent is extended or adjusted under 35 U.S.C. 154(b) by 365 days.

(21) Appl. No.: 16/779,448

(22) Filed: Jan. 31, 2020

(65) Prior Publication Data

US 2020/0248521 A1 Aug. 6, 2020

Related U.S. Application Data

(60) Provisional application No. 62/801,034, filed on Feb. 4, 2019.

(51) Int. Cl.
*E21B 31/20* (2006.01)
*E21B 23/04* (2006.01)

(52) U.S. Cl.
CPC ..... *E21B 31/20* (2013.01); *E21B 23/04* (2013.01)

(58) Field of Classification Search
CPC ..... E21B 31/20; E21B 23/04
See application file for complete search history.

(56) References Cited

U.S. PATENT DOCUMENTS 1,457,139 A * 5/1923 Bell ..... E21B 23/04 166/212
2,806,534 A * 9/1957 Potts ..... E21B 31/20 166/98
3,768,562 A * 10/1973 Baker ..... E21B 33/146 251/74
4,184,504 A * 1/1980 Carmichael ..... E21B 34/02 137/15.13
5,427,504 A * 6/1995 Dinning ..... E21B 43/121 417/59
5,470,118 A * 11/1995 Burton ..... E21B 31/12 294/86.18
5,549,163 A 8/1996 Sieber
5,580,114 A * 12/1996 Palmer ..... E21B 23/04 294/86.15
5,941,311 A 8/1999 Newton
6,148,923 A * 11/2000 Casey ..... E21B 43/121 166/372
6,554,580 B1 * 4/2003 Mayfield ..... E21B 43/121 417/59
7,021,382 B2 * 4/2006 Angman ..... E21B 23/10 294/86.23
7,096,951 B2 8/2006 Cox
7,121,335 B2 * 10/2006 Townsend ..... E21B 43/121 166/105
7,314,080 B2 * 1/2008 Giacomino ..... E21B 34/14 417/56

(Continued)

*Primary Examiner* — Aaron L Lembo
(74) *Attorney, Agent, or Firm* — Critical Path IP Law, LLC

(57) ABSTRACT

An enhanced geometry receiving element for a downhole tool, such as an enhanced geometry receiving element for a plunger downhole tool used in the oil and gas industry. In one embodiment, the enhanced geometry receiving element includes a set of axial grooves disposed in the interior of a fishing neck portion of a bypass plunger.

20 Claims, 18 Drawing Sheets

(56) References Cited

U.S. PATENT DOCUMENTS

| | | | | |
|---|---|---|---|---|
| 7,395,865 | B2 | 7/2008 | Bender | |
| 7,431,079 | B1 * | 10/2008 | Chavez | E21B 34/063 166/194 |
| 7,793,728 | B2 | 9/2010 | Bender | |
| 8,365,826 | B2 | 2/2013 | Braddick | |
| 8,464,798 | B2 | 6/2013 | Nadkrynechny | |
| 8,627,892 | B2 | 1/2014 | Nadkrynechny | |
| 8,869,902 | B2 | 10/2014 | Smith | |
| 9,068,443 | B2 * | 6/2015 | Jefferies | E21B 43/123 |
| 9,109,424 | B2 * | 8/2015 | Jefferies | E21B 43/121 |
| D767,737 | S * | 9/2016 | Kuykendall | D23/266 |
| 9,624,764 | B2 | 4/2017 | Fleckenstein | |
| 9,670,757 | B2 * | 6/2017 | Wessel | F04B 47/02 |
| 9,677,395 | B2 | 6/2017 | Affre De Saint Rome | |
| 9,915,133 | B2 * | 3/2018 | Boyd | E21B 34/08 |
| 10,060,235 | B2 * | 8/2018 | Damiano | F04B 47/12 |
| 10,215,004 | B2 * | 2/2019 | Wilkinson | E21B 43/121 |
| 10,550,674 | B2 * | 2/2020 | Boyd | F04B 47/12 |
| 10,669,824 | B2 * | 6/2020 | Boyd | E21B 43/121 |
| 2003/0155117 | A1 * | 8/2003 | Gray | E21B 43/121 166/107 |
| 2005/0056416 | A1 * | 3/2005 | Gray | E21B 43/121 166/101 |
| 2017/0107802 | A1 * | 4/2017 | Kuykendall | F04B 39/0016 |
| 2017/0247989 | A1 * | 8/2017 | Casey | F04B 53/126 |
| 2017/0268318 | A1 * | 9/2017 | Roycroft | E21B 43/121 |
| 2020/0088003 | A1 * | 3/2020 | Wardley | E21B 31/005 |

* cited by examiner

SECTION A-A

DETAIL B

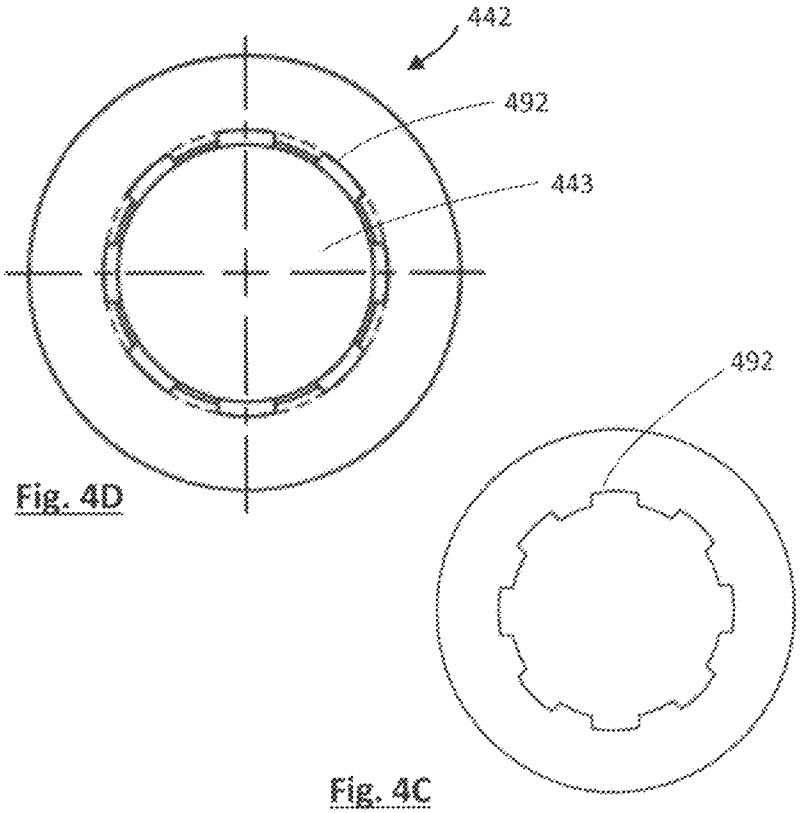
Fig. 4D
Fig. 4C
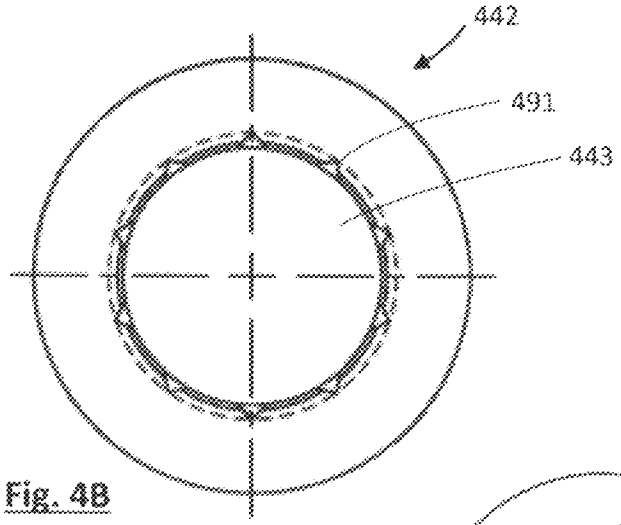
Fig. 4B
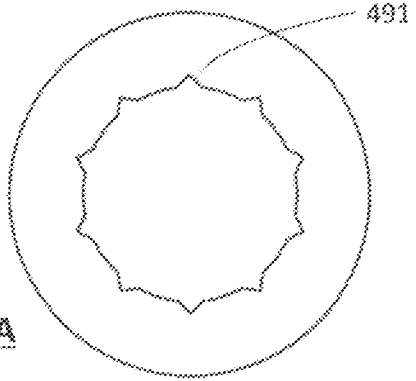
Fig. 4A

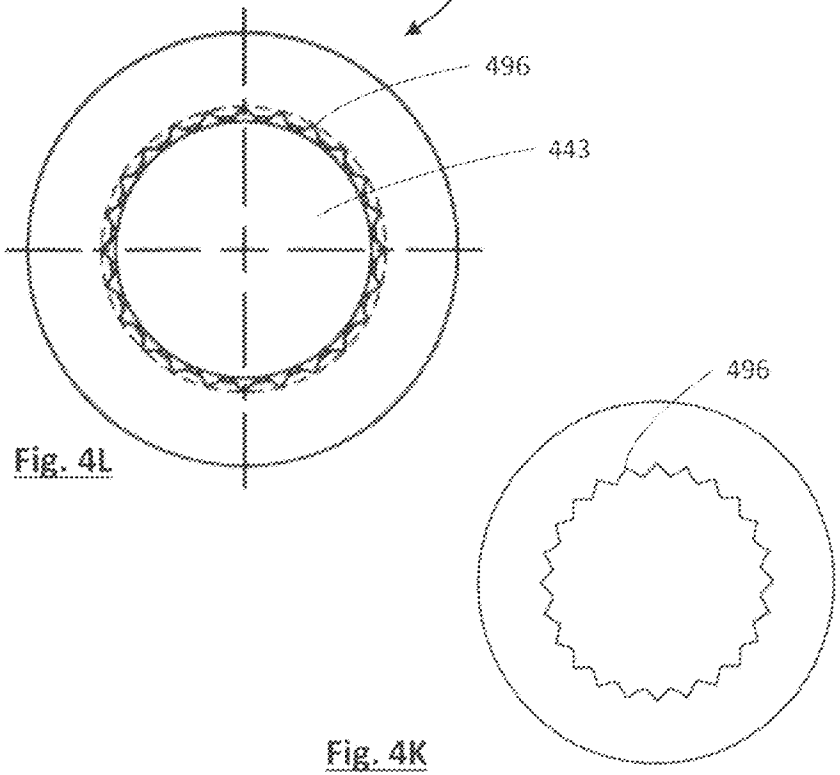
Fig. 4L
Fig. 4K
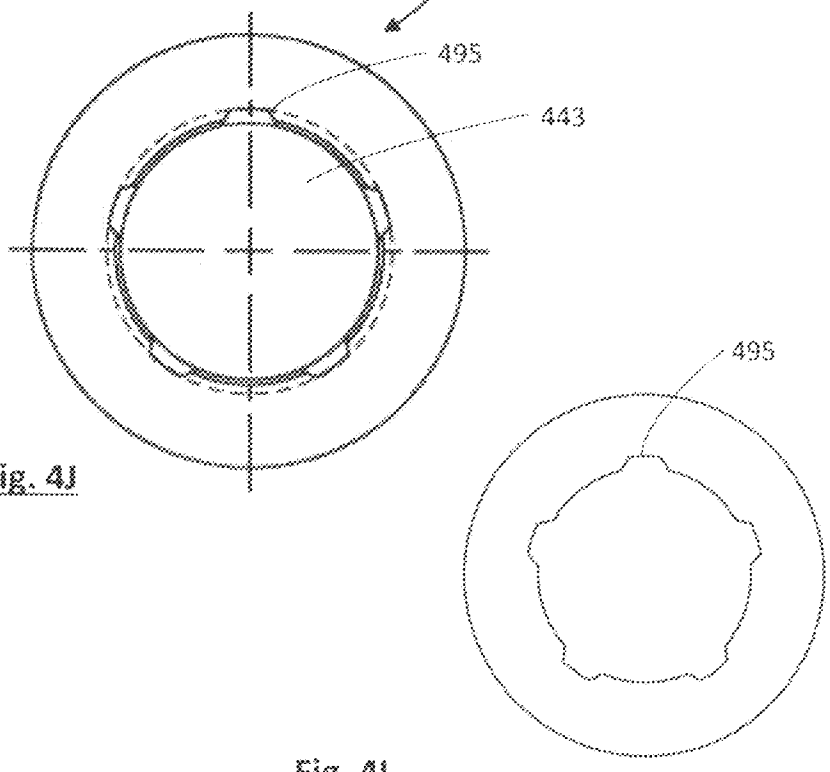
Fig. 4J
Fig. 4I 500
552

500
552

552
550
543

Figs. 6A-C are scaled drawings

Figs. 6D-E are scaled drawings

Figs. 6F-H and 6J-K
are scaled drawings
642
643
DETAIL B

670
DETAIL B X QTY.

SECTION M-M 600
644
SECTION M-M

SECTION G-G

DETAIL H

DETAIL D

SECTION C-C

SECTION E-E

DETAIL F

Fig. 10C DETAIL J

DETAIL L

SECTION K-K

ENHANCED GEOMETRY RECEIVING ELEMENT FOR A DOWNHOLE TOOL

CROSS-REFERENCE TO RELATED APPLICATION

This application is a nonprovisional patent application of and claims the benefit of U.S. Provisional Patent Application No. 62/801,034, filed Feb. 4, 2019 and titled "Enhanced Geometry Receiving Element for a Downhole Tool" the disclosure of which is hereby incorporated herein by reference in its entirety.

FIELD

The present invention is directed to an enhanced geometry receiving element for a downhole tool, such as an enhanced geometry receiving element for a plunger downhole tool used in the oil and gas industry.

BACKGROUND

Downhole tools commonly used in oil and gas wells require frequent retrieval from the well. Typically, downhole tools are recovered by way of engagement with an upper portion of the downhole tool. The retrieval tool is commonly called a "fishing tool" and the receiving area of the downhole tool is commonly called a "fishneck" or "fishing neck."

The fishing neck is configured in a standardized geometry to receive typical fishing tools. Most commonly, the fishing neck is configured with an internal lip within an internal diameter of the downhole tool to enable a fishing tool to engage and "catch" the downhole tool, thereby allowing the tool to be fished upwards and retrieved from the well. Such configurations are termed internal fishing neck configurations or conventional "inside grappling" configurations. The associated fishing tool which engages a conventional inside grappling configured downhole tool is termed a "conventional inside grappling fishing tool." Some fishing necks are configured to allow for retrieval of the downhole tool by engaging with an outer diameter of the downhole tool.

For downhole tools with internal fluid flow and with an internal fishing neck, the fluid flow leaving the tool and passing out from the fishing neck portion results in fluid drag. Such fluid drag slows the descent rate of a downhole tool when the tool is descending into a wellbore, aka when a downhole tool is "on the fall."

In oil and gas operations, heightened downhole tool descent rates are desirable. For example, when the downhole tool is a wellbore plunger used to remove fluid from a wellbore so as to maintain or resume production, the plunger may repeatedly fall and rise within a wellbore. The ability to quickly descend a plunger into a wellbore, and to reliably retrieve the plunger with a fishing tool, equates to increases in oil and gas production efficiencies.

The disclosure provides several embodiments of an enhanced geometry receiving element, aka a grooved receiving element, for a downhole tool. The enhanced geometry receiving element reduces descent drag of a downhole tool configured with a conventional internal fishing neck, while preserving the ability of conventional inside grappling fishing tools to engage with the internal fishing neck of the downhole tool.

The embodiments are applicable to any wellbore downhole tool configured with an internal fishing neck, to include interior flow through plungers used for artificial lift of well fluids. For a more detailed description of interior flow through plungers see, e.g., U.S. Pat. Nos. 7,395,865 and 7,793,728 to Bender; U.S. Pat. No. 8,869,902 to Smith et al; and U.S. Pat. Nos. 8,464,798 and 8,627,892 to Nadkrynechny, each of which are incorporated by reference in entirety for all purposes.

SUMMARY

An enhanced geometry receiving element for a downhole tool, such as an enhanced geometry receiving element for a plunger downhole tool used in the oil and gas industry, is disclosed. In one embodiment, the enhanced geometry receiving element includes a set of axial grooves disposed in the interior of a fishing neck portion of a bypass plunger.

The benefits of a downhole tool with an enhanced geometry receiving element, such as a grooved or notched receiving element adapted to fit with a fishing neck of an interior flow through plunger, include increased fall speed while maintaining the ability to engage with a conventional fishing tool, such as a conventional inside grappling fishing tool. An "interior flow through plunger" means any plunger in which fluid passes through at least some of an interior cavity of a plunger and including, for example, the set of plungers of FIGS. 5A-I, and plungers that are commonly termed "bypass plungers." Note that any embodiment and/or element of the disclosure that engages with, interconnects to, or otherwise references a "bypass plunger" or a "plunger" may also more broadly engage with, interconnect to, or reference an interior flow through plunger.

A downhole tool with enhanced geometry may be, without limitation, fitted to plungers which operate in conditions in which the travel time to the bottom of the wellbore is critical to production. The downhole tool with enhanced geometry reduces the time to the bottom of the wellbore by reducing drag and allowing fluid, e.g. hydrocarbons, gases and/or liquids, to bypass the plunger with less interference, thus increasing the relative speed of the plunger through the wellbore.

In one embodiment, a grooved receiving device forming a portion of a downhole tool is disclosed, the device comprising: a cylindrical body having an interior surface defining a cavity, the cylindrical body forming an upper portion of the downhole tool, the interior surface having a first diameter and comprising a plurality of axial grooves; wherein: the cavity is configured to pass a fluid received from an interior of the downhole tool; and each of the plurality of axial grooves extend radially into the interior surface to define a second diameter, the second diameter greater than the first diameter.

In one aspect, the grooved receiving device is configured to receive a conventional inside grappling fishing tool. In another aspect, the downhole tool is an interior flow through plunger tool configured for use in a hydrocarbon wellbore. In another aspect, a width of each of the axial grooves is no more than 0.75 inch. In another aspect, the axial grooves are concentric about a longitudinal centerline of the cylindrical body. In another aspect, each of the axial grooves extend axially into the interior surface to a first length. In another aspect, the second diameter is constant along the first length. In another aspect, the second diameter is variable along the first length. In another aspect, the plurality of axial grooves are rifled axial grooves. In another aspect, the plurality of axial grooves are two or more axial grooves. In another aspect, the first diameter defines a nominal inner diameter cross-sectional area of the upper portion of the downhole tool; the plurality of axial grooves extending radially into the interior surface define an enhanced geometry inner diameter cross-sectional area of the upper portion of the downhole tool; and the ratio of the grooved cross-sectional area to the nominal cross-sectional area is between 1.01 and 1.40. In another aspect, the first diameter defines a nominal perimeter of the upper portion of the downhole tool; the plurality of axial grooves extending radially into the interior surface define a grooved perimeter of the upper portion of the downhole tool; and the ratio of the grooved perimeter to the nominal perimeter is between 1.01 and 1.5.

In another embodiment, a grooved receiving device forming a portion of a downhole tool is disclosed, the device comprising: an interior surface defining a cavity of the grooved receiving device, the interior surface comprising a plurality of axial grooves and the cavity having a nominal first diameter, the interior surface coupled to a downhole tool interior surface; wherein: the cavity is configured to pass a fluid received from an interior cavity of the downhole tool; and each of the plurality of axial groves extend from the nominal first diameter to a second diameter, the second diameter greater than the nominal first diameter.

In one aspect, the downhole tool device is an interior flow through plunger. In another aspect, each of the set of axial grooves extend radially to a first length and are concentric about a longitudinal centerline of the downhole tool. In another aspect, the device forms a fishing neck adapted to receive a conventional inside grappling fishing tool. In another aspect, the plurality of axial grooves are three or more axial grooves. In another aspect, a width of each of the axial grooves varies along a longitudinal centerline of the downhole tool.

In yet another embodiment, a method of descending and retrieving a grooved fishing neck downhole tool within a tubular string of a wellbore is disclosed, the method comprising: positioning the grooved fishing neck downhole tool within the tubular string, the grooved fishing neck downhole tool comprising: a cylindrical body adapted to fit within the tubular string and having a body interior surface defining a cavity of a first diameter, the cavity adapted to pass a fluid from the cavity and out an upper portion of the cylindrical body; and a set of axial grooves disposed on the body interior surface at the upper portion, each of the set of axial grooves extending radially to a first depth and defining a second diameter; descending the grooved fishing neck downhole tool within the tubular string to a fixed location, wherein fluid passes through the set of axial grooves; lowering a conventional inside grappling fishing tool toward the grooved fishing neck downhole tool; engaging the conventional inside grappling fishing tool with at least a portion of the grooved fishing neck downhole tool adjacent the set of axial grooves; and pulling the conventional inside grappling fishing tool up the tubular string so as to retrieve the grooved fishing neck downhole tool.

In one aspect, the grooved fishing neck downhole tool is a grooved fishing neck internal flow through plunger.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

BRIEF DESCRIPTION OF THE DRAWINGS

The disclosure will be readily understood by the following detailed description in conjunction with the accompanying drawings, wherein like reference numerals designate like elements. The elements of the drawings are not necessarily to scale relative to each other. Identical reference numerals have been used, where possible, to designate identical features that are common to the figures.

FIG. 4A is a cut-away view of one embodiment of an enhanced geometry receiving element with triangular-shaped axial grooves;

FIG. 4B is a top view of the enhanced geometry receiving element of FIG. 4A;

FIG. 4C is a cut-away view of one embodiment of an enhanced geometry receiving element with square-shaped axial grooves;

FIG. 4D is a top view of the enhanced geometry receiving element of FIG. 4C;

FIG. 4I is a cut-away view of one embodiment of an enhanced geometry receiving element with trapezoidal-shaped axial grooves;

FIG. 4J is a top view of the enhanced geometry receiving element of FIG. 4I;

FIG. 4K is a cut-away view of one embodiment of an enhanced geometry receiving element with toothed-shaped axial grooves;

FIG. 4L is a top view of the enhanced geometry receiving element of FIG. 4K;

FIG. 10C is a close-up of a portion of FIG. 10B along circular portion J of FIG. 10B;

It should be understood that the proportions and dimensions (either relative or absolute) of the various features and elements (and collections and groupings thereof) and the boundaries, separations, and positional relationships presented there between, are provided in the accompanying figures merely to facilitate an understanding of the various embodiments described herein and, accordingly, may not necessarily be presented or illustrated to scale (unless so stated on any particular drawing), and are not intended to indicate any preference or requirement for an illustrated embodiment to the exclusion of embodiments described with reference thereto.

DETAILED DESCRIPTION

Embodiments of an enhanced geometry receiving element forming a portion of a downhole tool are disclosed. The enhanced geometry receiving element may also be referred to as a grooved receiving element or a grooved receiving device. The downhole tool may be used in oil and gas operations. In one embodiment, the downhole tool is a bypass plunger.

Generally, the enhanced geometry receiving element comprises a set of grooves in an upper portion of a downhole tool. The set of grooves are disposed in the internal fishing neck region of the downhole tool and allow improved outflow of plunger fluid while maintaining the ability of the fishing neck to receive conventional fishing tools, such as a conventional inside grappling fishing tool.

The term "groove" means a channel or cut of a defined length and width that penetrates an otherwise smooth surface to a particular depth, such as a channel cut along an interior surface of a cylindrical body along an axial length of the cylindrical body. A groove may or may not be of uniform depth, may or may not be of uniform width, and/or may or may not be of uniform length. A groove may or may not be formed in one principal direction of a surface; for example, a groove may be formed along an axial length of a cylindrical body, or may be formed along both an axial length or direction of a cylindrical body and a radial length or direction of a cylindrical body.

The term "port" means the same as the term "groove."

Various embodiments of an enhanced geometry receiving element and method of use will now be described with respect to FIGS. 1-12.

Figure 1:
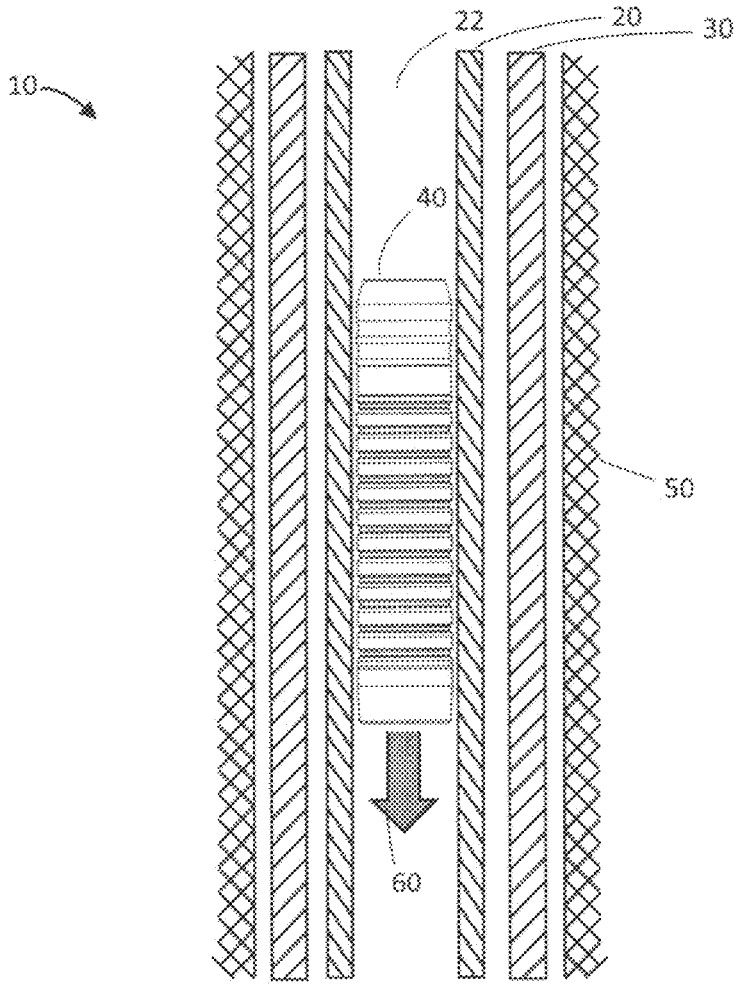
FIG. 1 is a schematic diagram of plunger tool in a wellbore.

FIG. 1 depicts a cross-sectional view of a conventional downhole tool 40 in a well 10, the conventional downhole tool 40 configured as a bypass plunger. Generally, below the surface a well 10 comprises a wellbore 50 formed from the surface to a producing zone, the wellbore 50 drilled so as to define a cavity within the earth 50. A production casing 30 is disposed within the wellbore 50, and production tubing 20 (aka a production string or tubular string) is disposed within the production casing 30. A downhole tool 40, such as a plunger, fits within the production tubing 20. For a more detailed description of well configurations and operations, see, for example, U.S. Pat. No. 9,624,764 to Fleckenstein, incorporated by reference in entirety for all purposes.

The downhole tool 40 traverses the interior annulus or cavity formed by the production tubing 20. More specifically, the downhole tool 40 descends or falls from the surface downwards into the wellbore toward the production zone (from up to down in FIG. 1) and ascends or rises from the production zone upwards toward the surface (from down to up in FIG. 1). A downhole tool descending toward a production zone from the surface is termed "on the fall" and a downhole tool ascending from a production zone to the surface is termed "on the rise." Downhole tool descent arrow 60 is shown in FIG. 1. When the downhole tool 40 is a bypass plunger, or any downhole tool with an interior that passes fluid between upper and lower ends, fluid within the tubing will enter a lower portion of the downhole tool, travel through the interior of the tool, and depart from an upper portion of the tool when the tool is descending, as depicted in FIG. 1. The word "fluid" means a substance that has no fixed shape and yields at least partially to external pressure, to include liquids and gases, such as water and hydrocarbons to include hydrocarbon gases and hydrocarbon liquids.

Figure 2A:
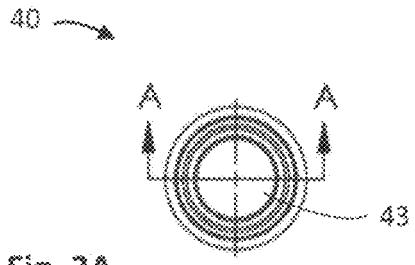
FIG. 2A is a top view of a conventional bypass plunger with a conventional fishing neck.
Figure 2B:
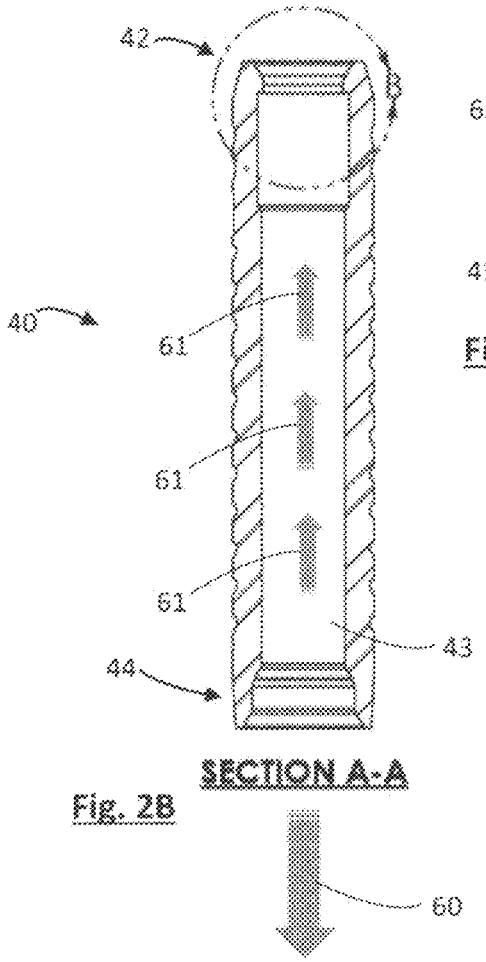
FIG. 2B is a cross-sectional side-view of the conventional bypass plunger with a conventional fishing neck of FIG. 2A, illustrating fluid flow during wellbore descent.
Figure 2C:
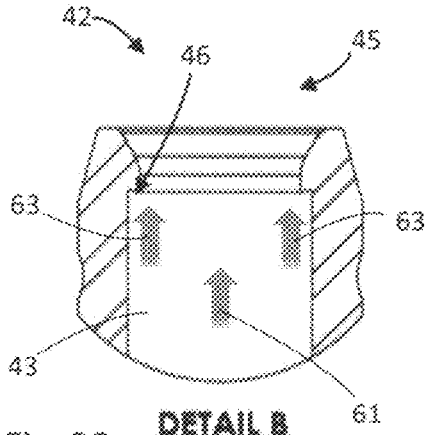
FIG. 2C is a close-up of the upper portion of FIG. 2B, illustrating fluid flow within the upper portion of the conventional bypass plunger with a conventional fishing neck during wellbore descent.

FIGS. 2A-C depict fluid flow of a conventional bypass plunger 40 with a conventional fishing neck 45 during descent along descent arrow 60. FIG. 2A depicts a top view of the conventional bypass plunger 40 comprising interior 43. FIG. 2B depicts a cross-sectional side view of the conventional bypass plunger 40 along section A-A of FIG. 2A, detailing upper portion 42 and lower portion 44, interior 43, and interior center flow 61. FIG. 2C depicts a detail portion B of FIG. 2B, depicting details of the fishing neck portion 45. Each of FIGS. 2B-C depict fluid flow lines associated with the plunger with conventional fishing neck during wellbore descent. FIGS. 2A-C are scaled drawings.

As the conventional bypass plunger 40 descends within a wellbore in the direction of descent arrow 60, fluid within the tubular string enters the tool at second or lower portion 44 of plunger 40, passes through hollow interior 43 of plunger 40, and exits at first or upper portion 42 of plunger 40. The upper portion 42 of plunger comprises fishing neck portion 45. The fishing neck portion of plunger 40 comprises a lip portion 46 that extends radially into the interior 43 of the plunger 40.

The internal fishing neck 45 on a plunger is designed for downhole retrieval. If a plunger becomes stuck in the tubing string, e.g. becomes lodged at the tubing string bottom (i.e. there is not enough velocity to push the tool to surface), a separate retrieval tool (male) will interlock with the plunger's internal fishing neck (female), and the plunger will be pulled and thus removed from the well. This removal may be done through wire lining or pulling rods.

The internal fishing neck may be used on any plunger type but is most frequently used on plungers where fluid flows through the inner portions of the plunger. This type of plunger may go by the name of Continuous run, Ball-and-sleeve, dart style plungers, and bypass plungers. As the fluid goes past this feature, the increase of drag may be noticeable in several ways, as discussed below.

As interior edge flow 63 passes within the interior 43 of plunger, the flow encounters the lip portion 46, resulting in a flow interruption that generates drag of the plunger 40. Stated another way, the interior edge flow 63 within the bypass plunger that impacts the lip portion 46 creates a flow discontinuity or flow disruption that interrupts otherwise upwardly smooth flow (such as that of the interior center flow 61) that in turn generates fluid drag on the plunger 40. In some situations, the flow discontinuity results in turbulence of otherwise smooth fluid flow within the interior 43 of the plunger 40. In some configurations of downhole tools configured with conventional fishing neck interiors, the flow discontinuity results in a fluid flow discontinuity or non-laminar flow at or around the lip portion 46 of the fishing neck 45 of otherwise smooth fluid flow within the interior 43 of the plunger 40, in turn inducing additional drag on the plunger 40 and thereby retarding the descent speed of the plunger 40. In some configurations of downhole tools configured with conventional fishing neck interiors, the interior edge flow 63 results in compression of the fluid at or adjacent or near the lip portion 46, which in turn induces additional drag on the plunger 40 and thereby retards or slows the descent speed of the plunger 40.

Generally, as briefly discussed above, a fishing neck of a downhole tool, such as a bypass plunger downhole tool, configured with a set of axial groves on the interior portion of the fishing neck mitigates or removes flow discontinuity or flow disruption along the interior edge of the fishing neck, thereby limiting if not eliminating the induced drag generated by the lip portion of a fishing neck and thus increasing the descent speed of the downhole tool.

Figure 3B:
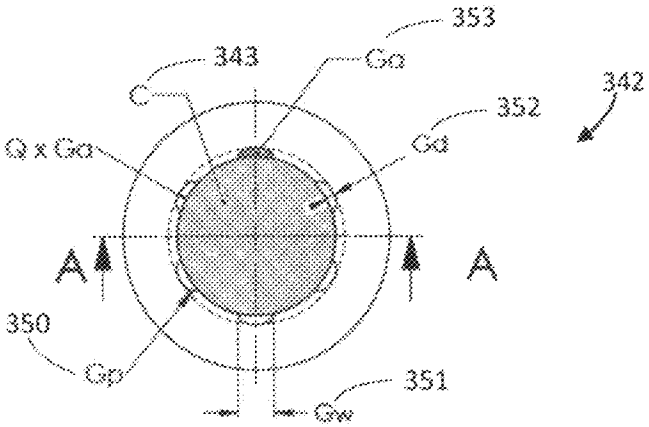
FIG. 3B is a top view of the bypass plunger fitted with an enhanced geometry receiving element of FIG. 3A.
Figure 3C:
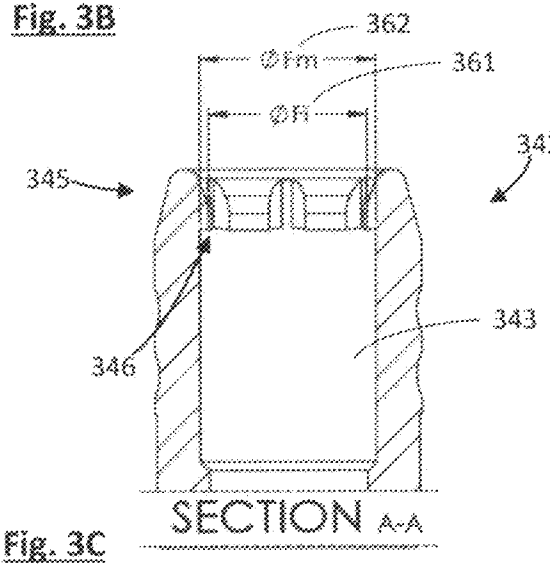
FIG. 3C is a cross-sectional close-up view of the upper portion of the bypass plunger fitted with an enhanced geometry receiving element of FIG. 3A, the cross-section taken along line A-A of FIG. 3B.
Figure 3A:
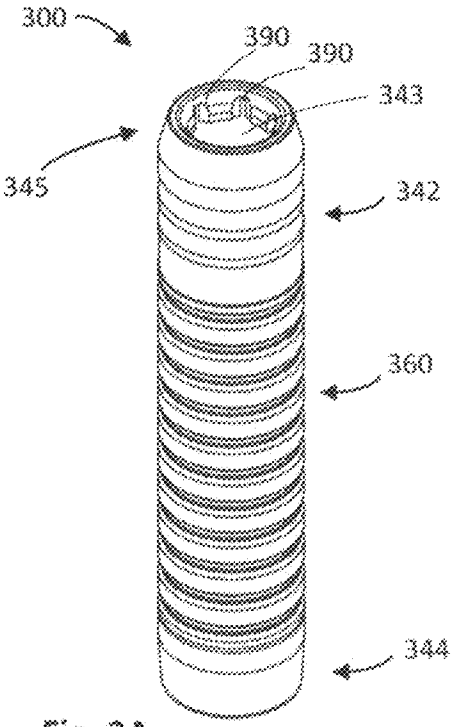
FIG. 3A is a perspective view of one embodiment of a bypass plunger fitted with an enhanced geometry receiving element.

FIGS. 3A-C depict one embodiment of an enhanced geometry receiving element (aka a grooved receiving device) coupled with an upper portion of a bypass plunger resulting in a grooved fishing neck downhole tool 300. FIG. 3A is a perspective view of a bypass plunger with enhanced geometry receiving element 300. FIG. 3B is a top view of a bypass plunger with enhanced geometry receiving element 300. FIG. 3C depicts a cross-sectional close-up view along section A-A of FIG. 3B. FIGS. 3A-C are scaled drawings.

The grooved fishing neck downhole tool 300 may also be referred to more concisely as a bypass plunger 300.

Bypass plunger 300 comprises a lower portion 344, an upper portion 342, and an interior portion 343. The bypass plunger 300 has a maximum outer diameter 360. The interior portion 343 is configured to allow fluid to pass axially within interior portion 343 from upper portion 342 to lower portion 344, and vice versa. The upper portion 342 comprises fishing neck 345.

The fishing neck 345 comprises a set of axial grooves 390. The axial grooves 345 mitigate or reduce or eliminate disruption to fluid flowing within the plunger and passing from the lower portion 344 to the upper portion 342 from within the interior 343.

Each of the axial grooves 390 are disposed on an interior of the fishing neck 345 and extend radially into the interior surface of the fishing neck 345. Furthermore, each of the axial grooves 390 extend into an interior surface of the upper portion 342 of the plunger 300. Each of the axial grooves 390 has a groove profile 350, a groove width 351, a groove depth 352, and a groove area 353. The groove depth 352 is defined by half of the difference between maximum fish neck diameter 362 and the inner fishing neck diameter 361. (Note that in some embodiments, the groove depth 352 is other than one-half the afore-mentioned distance, meaning the groove depth 352 is other than half of the difference between maximum fish neck diameter 362 and the inner fishing neck diameter 361. Stated another way, in some embodiments, the groove depth 352 is more than half of the difference between maximum fish neck diameter 362 and the inner fishing neck diameter 361, and in some embodiments, the groove depth 352 is less than half of the difference between maximum fish neck diameter 362 and the inner fishing neck diameter 361. Also, in some embodiments, the groove diameter varies with axial length along the fishing neck, and/or varies among the set of grooves that form the enhanced geometry receiving element.) The configuration of axial grooves 390 of FIGS. 3A-C may be termed a rounded corner configuration or a rounded corner embodiment.

FIGS. 3B-C also allow provide descriptions of mathematical relationships between elements or geometries of the enhanced geometry receiving element. Groove area 353 may be designated as Ga; groove profile 350 as Gp; groove width 351 as Gw; groove depth 352 as Gd; interior portion 343, aka area of flow through without grooves, as C; quantity or number of grooves as Q; maximum fish neck diameter 362 as Fm; and inner fishing neck diameter 361 as Fi.

Using these parameters, the area of the new flow through area, termed the "enhanced geometry inner diameter cross-sectional area," is:

$$A=(Ga\times Q)+C$$

Also, groove depth is defined as:

$$Gd=(Fm-Fi)/2$$

In one embodiment:

$$Gw\leq 0.75 \text{ inch}$$

With reference to FIGS. 3A-B, a conventional bypass plunger with a conventional interior fishing neck 345 with lip 346 has a nominal inner diameter cross-sectional area C. A set of grooves with groove profile 350 create additional cross-sectional area 353 times the number of grooves, yielding the enhanced geometry inner diameter cross-sectional area A, as provided above.

In one embodiment, Gw is below 0.90 inch. In a more preferred embodiment, Gw is below 0.85 inch. In a most preferred embodiment, Gw is below 0.80 inch.

In one embodiment, Gw is between 0.3 inch and 1.0 inch. In a more preferred embodiment, Gw is between 0.4 inch and 0.9 inch. In a most preferred embodiment, Gw is between 0.4 inch and 0.8 inch.

Note that by using the enhanced geometry inner diameter cross-sectional area A relative to the nominal inner diameter cross-sectional area C as a description of the configuration of the set of grooves, any arrangement of grooves (e.g. in number or in shape) that yields that same nominal area C should produce the same or similar performance in plunger fall rate. For example, for a plunger of Fi=1.070 inch and Fm=1.230 inch, a C=0.899 $inch^2$ results; in one embodiment, A=1.006 $inch^2$ and thus a ratio A/C of 1.12 may be calculated. In one embodiment, the ratio A/C is about 1.12. In one embodiment, the ratio A/C is between 1.0 and 1.3. In a more preferred embodiment, the ratio A/C is between 1.05 and 1.25. In a most preferred embodiment, the ratio A/C is between 1.10 and 1.15.

In one embodiment, the ratio A/C is between 1.01 and 1.40. In another embodiment, the ratio A/C is between 1.02 and 1.5.

As provided above with regards to FIGS. 3A-B, the nominal groove depth (for this particular embodiment) is half of the difference between the maximum fishing neck diameter and the inner fishing neck diameter. (Note that the term "inner" is equivalent to the term "internal" and refers to a surface or component positioned within a defined volume or cavity, such as an inner diameter portion within cylindrical volume.) In some embodiments, as provided above with respect to FIGS. 3A-C or any of the embodiments disclosed, the groove depth is less than the nominal groove depth. In some embodiments, the groove depth is more than the nominal groove depth. In some embodiments, the set of grooves are of different groove depths, to include more than, substantially equal to, and less than, the nominal groove depth.

In the embodiment of FIGS. 3A-C, six identical axial grooves 390 are formed in the interior of the fishing neck 345 and are concentric about a longitudinal centerline of the plunger. The fishing neck 345, as configured with the set of axial grooves 390, is able to engage a conventional inside grappling fishing tool. Stated another way, the set of six identical axial grooves 390 does not inhibit or prevent the ability of the plunger to engage an inside grappling fishing tool by way of the otherwise conventional interior fishing neck geometry.

Each of the axial grooves 390 extend an axial distance within the interior of the fishing neck 345. In some embodiments, one or more of the axial grooves extend substantially the entire length of the fishing neck 390. In some embodiments, one or more of the axial grooves extend along a portion of the entire length of the fishing neck 390. In some embodiments, a subset of the axial grooves extends along a portion of the entire length of the fishing neck 390, and another subset of the axial grooves extend along a portion of the entire length of the fishing neck 390. In one embodiment, one or more of the axial grooves 390 are not concentric about a longitudinal centerline of the plunger. In some embodiments, the set of axial grooves are of different groove profiles; for example, every other groove may be of a first groove width and the remaining grooves may be of a second groove width.

The interior fluid flow, during plunger descent, within a conventional bypass plunger with a conventional fishing neck (such as depicted in FIGS. 2A-C) may be compared with the fluid flow within a bypass plunger fitted with an enhanced geometry receiving element (such as depicted in FIGS. 3A-C).

In simulation and/or testing of the fluid flow of a conventional bypass plunger with a conventional fishing neck during wellbore descent and a bypass plunger with an enhanced geometry receiving element during wellbore descent, flow differences in the upper plunger portion are apparent. For common flow conditions (e.g. flow rates, flow pressures, etc.) and geometries (e.g. interior plunger diameters, exterior tubular string diameter, etc.), with the only difference being the presence of the enhanced geometry receiving element, the plunger fitted with the enhanced geometry receiving element (e.g. FIGS. 3A-C) results in smoother and less disrupted fluid flow than the conventional plunger (e.g. FIGS. 2A-C), which in turn results in a reduction of plunger drag and thus an increase in descent or fall rate of the plunger.

For a conventional bypass plunger with a conventional fishing neck (such as depicted in FIGS. 2A-C), interior center fluid flows 61 flows within interior 43 of the upper portion 42 of a conventional bypass plunger, with interior edge flow 63 encountering lip portion 46. The interior edge flow 63 is disrupted when encountering lip portion 46, resulting in a flow disturbance that generates drag of the plunger. Stated another way, the interior edge flow 63 within the bypass plunger that impacts the lip portion 46 generates a flow discontinuity or flow disruption that interrupts otherwise upwardly smooth flow (such as that of the interior center flow 61) that in turn generates fluid drag on the plunger. The flow discontinuity may be turbulence of otherwise smooth fluid flow within the interior 43 of the plunger. The flow discontinuity may result in turbulent or non-laminar flow at or around the lip portion 46 of the fishing neck area of otherwise smooth fluid flow within the interior 43 of the plunger, in turn inducing additional drag on the plunger and thereby retarding the descent speed of the plunger. In some configurations of downhole tools configured with conventional fishing neck interiors, the interior edge flow 63 results in an area of fluid compression 65 of the fluid at or adjacent or near the lip portion 46, which in turn induces additional drag on the plunger and thereby retards or slows the descent speed of the plunger.

In contrast, a plunger fitted with the enhanced geometry receiving element (e.g. FIGS. 3A-C) results in little if any discernable flow disruption within the interior 343, to include, for example, little if any fluid compression of the fluid is at or adjacent or near the lip portion 346. The minimization if not elimination of flow disruption near or adjacent the lip portion 346 of an interior fishing neck results in a reduction of plunger drag and thus an increase in descent or fall rate of the plunger.

FIGS. 4A-L depict a set of six (6) other embodiments of the enhanced geometry receiving element, each comprising a set of axial grooves that form a particular groove profile extending into an interior surface of an upper portion 442 of a downhole tool, the interior surface defining an aperture, cavity, or interior 443 of the downhole tool. FIGS. 4A-L are scaled drawings. Note that the various embodiments of the enhanced geometry receiving element (aka the grooved receiving device) of FIGS. 4A-L may be fitted with a downhole tool, such as a plunger, to create a grooved fishing neck downhole tool 300. The set of axial grooves are concentric about a longitudinal centerline of a downhole tool, such as a plunger. Each of the embodiments of FIGS. 4A-L depict a top-view of the upper portion 442 of a bypass plunger 300 with enhanced geometry receiving element. Other configurations and/or geometries are possible although not shown. Like all embodiments of the disclosure, elements and/or features of some embodiments may be combined with others, and some elements or features may be added or deleted. Also, any particular embodiment may differ in the number of a given feature, such as number of axial grooves. As one non-limiting example, the set of ten (10) triangular grooves of FIGS. 4A-B could instead number eight (8) axial grooves or eleven (11) triangular grooves. Further, as another non-limiting example, the embodiment of FIGS. 4A-B could be combined with the embodiment of FIGS. 4C-D such that the grooves alternate between triangular grooves and squared grooves.

FIGS. 4A-B depict an embodiment of an enhanced geometry receiving element of a fishing neck portion of a downhole tool configured with a triangular groove profile 491. A set of ten (10) such triangular grooves are depicted, at equal radial distances or every 36 degrees.

Figure 4H:
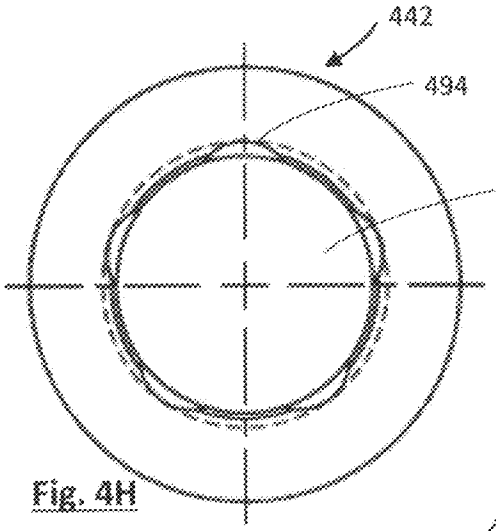
FIG. 4H is a top view of the enhanced geometry receiving element of FIG. 4G.
Figure 4G:
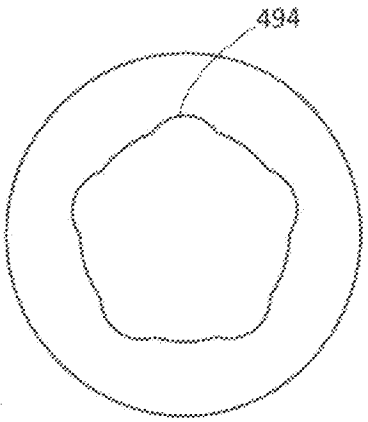
FIG. 4G is a cut-away view of one embodiment of an enhanced geometry receiving element with circular-shaped axial grooves.
Figure 4F:
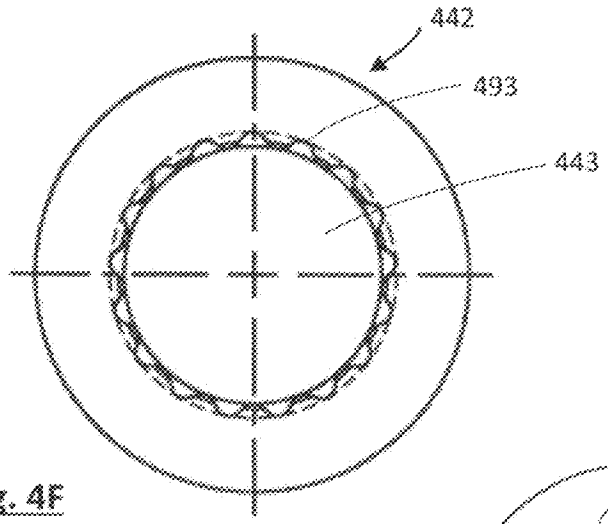
FIG. 4F is a top view of the enhanced geometry receiving element of FIG. 4E.
Figure 4E:
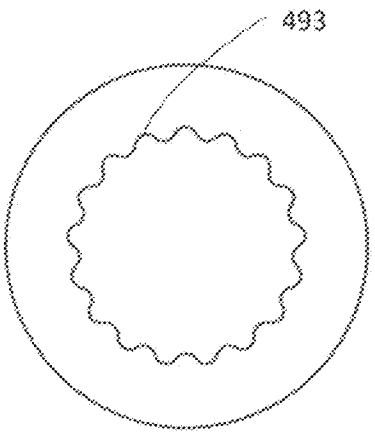
FIG. 4E is a cut-away view of one embodiment of an enhanced geometry receiving element with wave-shaped axial grooves.

FIGS. 4C-D depict an eight-element squared corner groove profile 492 embodiment, wherein the edges of the grooves are substantially squared off in cross section. FIGS. 4C-D depict a seventeen-element wave profile 493 embodiment, wherein the edges of the grooves form a sinusoidal-like wave in cross section. FIGS. 4G-H depict a five-element circular groove profile 494 wherein the profile of the cut into the interior of the fishing neck portion is an arc of a circle. FIGS. 4I-J depict a five-element trapezoidal profile 495, similar to the squared profile of FIGS. C-D but with edges angled or extending outwards. Lastly, FIGS. 4L-K depict a toothed profile 496, each tooth similar to the triangle profile of FIGS. 4A-B but with little if any unaltered interior surface remaining.

Also mentioned above, note that other geometries of groove profiles are possible other than those depicted in FIGS. 4A-L, and the groove profiles may be mixed and matched. For example, a set of eight axial grooves may be formed, wherein every other groove if a rounded corner groove (as described in FIGS. 3A-C) and remaining grooves are of triangular profile (as described in FIGS. 4A-B). Also, other numerical configurations are possible, such as sets of three, four, etc. numbers of triangular grooves in addition to the configuration of ten triangular grooves of FIGS. 4A-B.

The enhanced geometry receiving element may be adapted or configured to operate with any downhole tool that comprises an internal fishing neck (aka an inside grappling fishing neck). For example, the enhanced geometry receiving element may be adapted or configured to operate with any bypass plunger. FIGS. 5A-I depict a set of three (3) embodiments of the enhanced geometry receiving element coupled with three (3) types of bypass plungers.

Figures 5A, 5B, 5C:
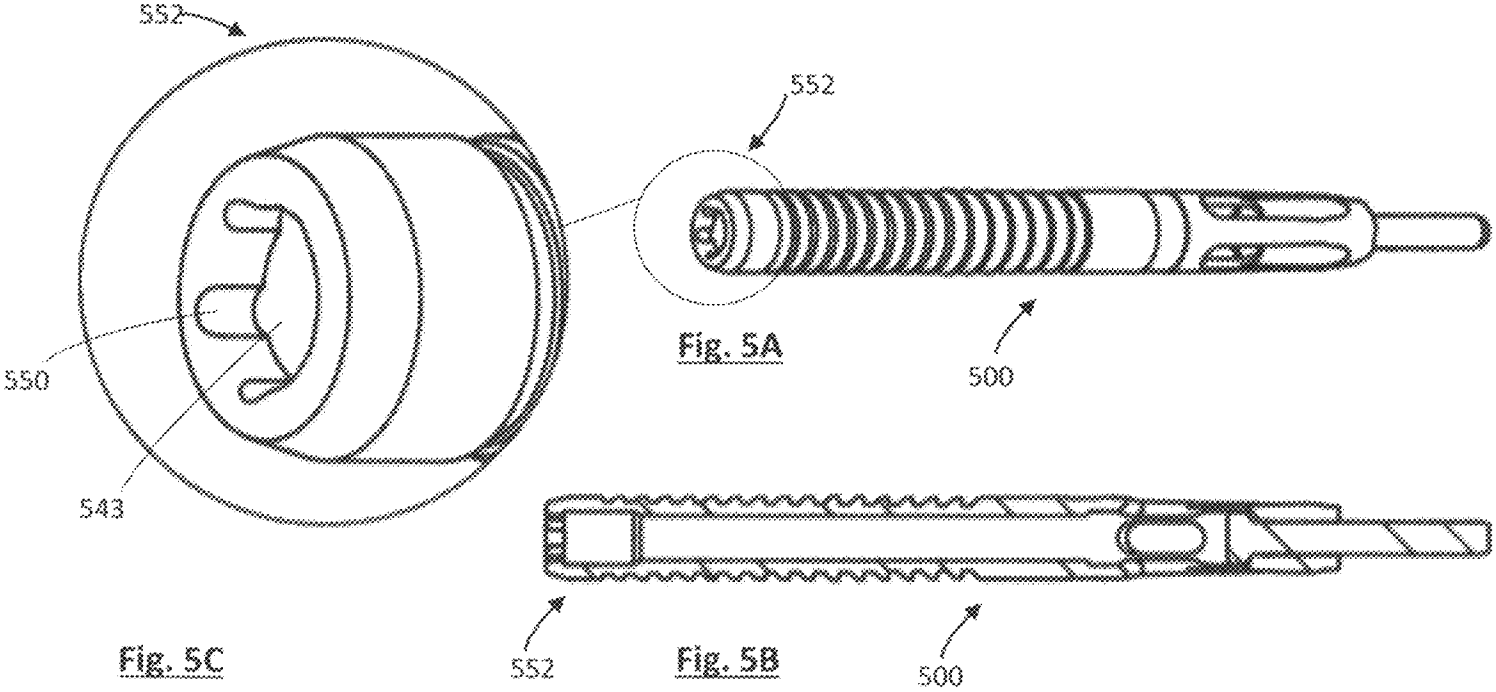
FIG. 5A is a perspective view of another embodiment of a bypass plunger fitted with an enhanced geometry receiving element.
FIG. 5B is a cross-sectional side view of the bypass plunger fitted with an enhanced geometry receiving element of FIG. 5A.
FIG. 5C is a close-up of the upper portion of FIG. 5A.
Figure 5D:
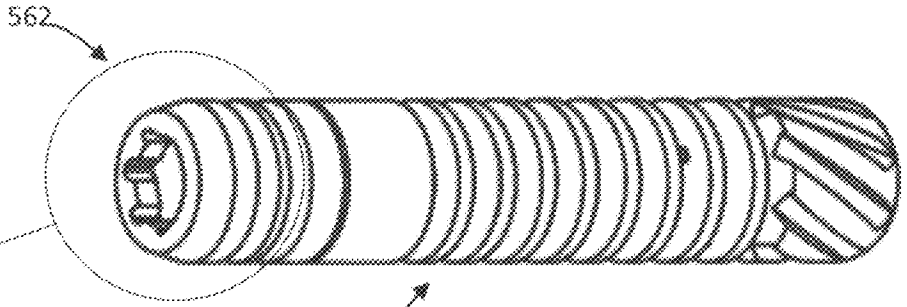
FIG. 5D is a perspective view of another embodiment of a bypass plunger fitted with an enhanced geometry receiving element.
Figure 5E:
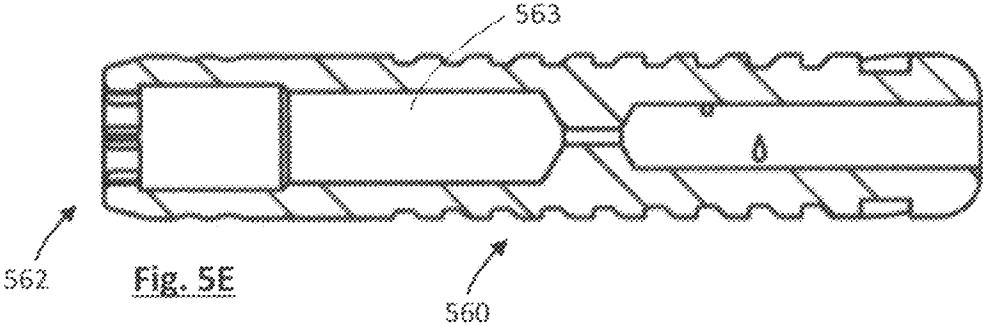
FIG. 5E is a cross-sectional side view of the bypass plunger fitted with an enhanced geometry receiving element of FIG. 5D.
Figure 5F:
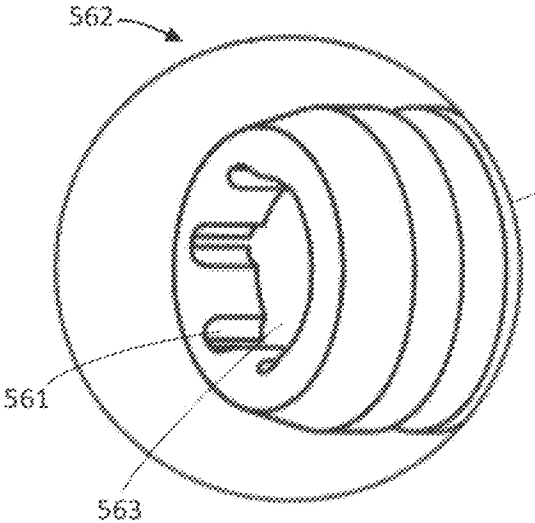
FIG. 5F is a close-up of the upper portion of FIG. 5D.
Figure 5G:
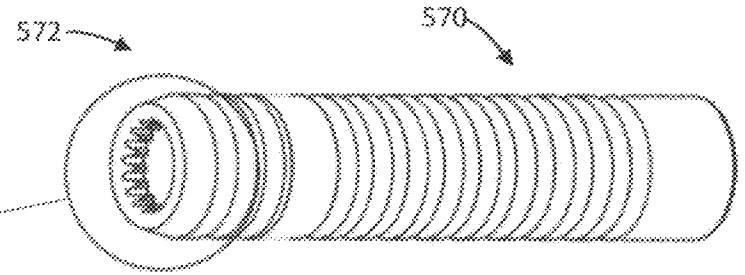
FIG. 5G is a perspective view of another embodiment of a bypass plunger fitted with an enhanced geometry receiving element.
Figure 5H:
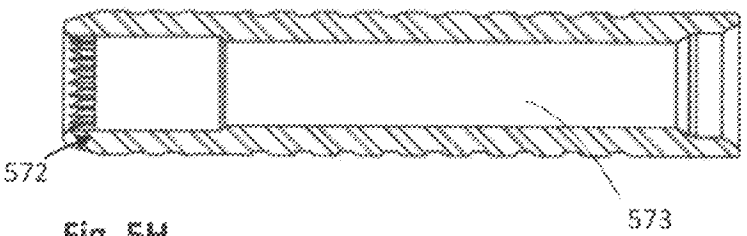
FIG. 5H is a cross-sectional side view of the bypass plunger fitted with an enhanced geometry receiving element of FIG. 5G.
Figure 5I:
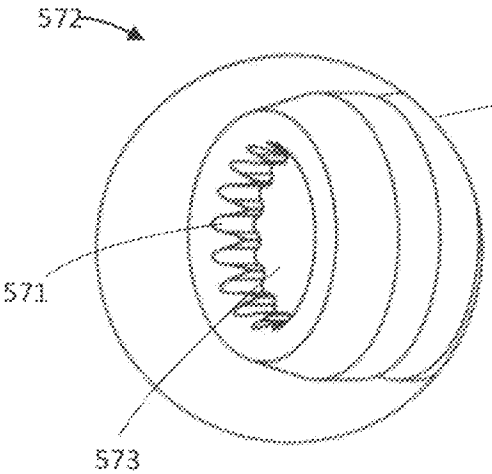
FIG. 5I is a close-up of the upper portion of FIG. 5G.

FIGS. 5A-C depict a dart plunger 500 adapted with a five-element radial profile 550 embodiment of the enhanced geometry receiving element disposed on interior surface of interior 543 at upper portion 552. The radial profile 550 is similar to the circular profile of FIGS. 4G-H. FIGS. 5D-F depict a quick drop plunger 560 with a six-element radius profile 561 embodiment of the enhanced geometry receiving element disposed on interior surface of interior 563 at upper portion 562. The radius profile 561 is similar to the rounded corner profile of FIGS. 3A-C. FIGS. 5G-I depict a sleeve plunger with a multi-element sprocket profile 571 embodiment of the enhanced geometry receiving element disposed on interior surface of interior 573 at upper portion 572.

FIGS. 6A-H and 6J-K depict another embodiment of a grooved fishing neck downhole tool 600 adapted with an enhanced geometry receiving element 690. The grooved fishing neck downhole tool 600 may also be referred to as simply a bypass plunger 600.

The set of FIGS. 6A-H and 6J-K are scaled drawings. Bypass plunger 600 comprises interior 643, upper end portion 642, and lower end portion 644. The interior 643 comprises an interior surface and defines an inner diameter 661 for a majority of the axial length of the cylindrical body of the bypass plunger 600. The enhanced geometry receiving element 690 is configured in a rounded corner configuration, similar to that depicted in FIGS. 3A-C. The set of six axial grooves of groove profile 690 are configured to minimize, reduce, mitigate, and/or eliminate disruption in fluid flow around or adjacent the lip area 646 of the interior fishing neck portion.

Figure 6C:
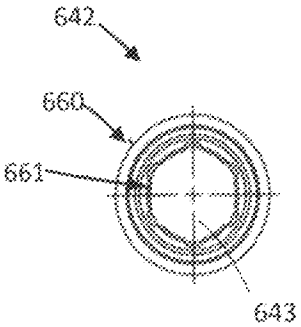
FIG. 6C is a top view of the bypass plunger fitted with an enhanced geometry receiving element of FIG. 6A.
Figure 6B:
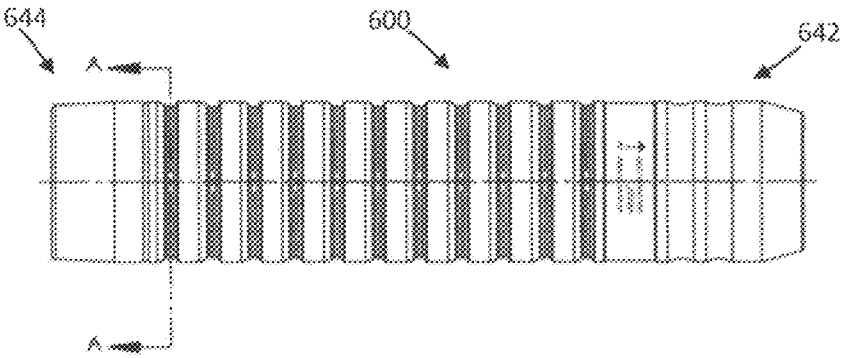
FIG. 6B is a side view of the bypass plunger fitted with an enhanced geometry receiving element of FIG. 6B.
Figure 6A:
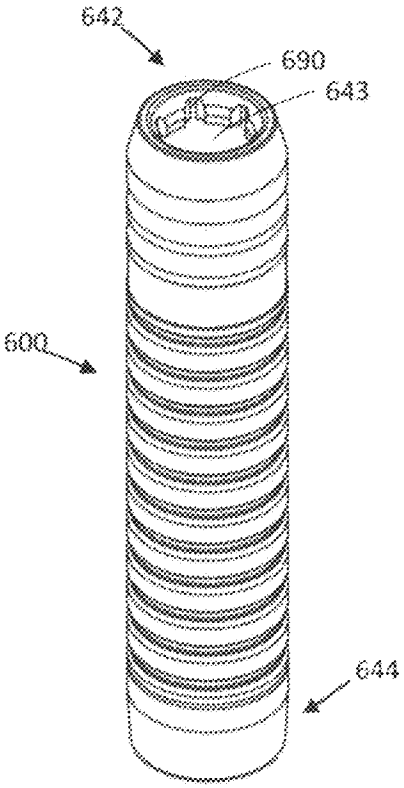
FIG. 6A is a perspective view of another embodiment of a bypass plunger fitted with an enhanced geometry receiving element.
Figure 6D:
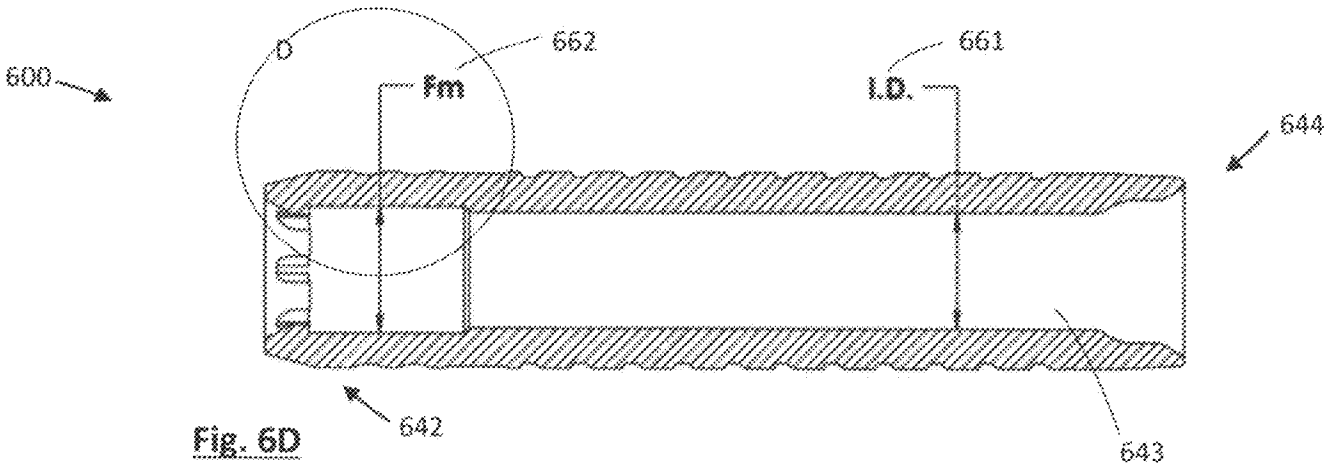
FIG. 6D is a cut-away side view of the bypass plunger fitted with an enhanced geometry receiving element of FIG. 6A.
Figure 6E:
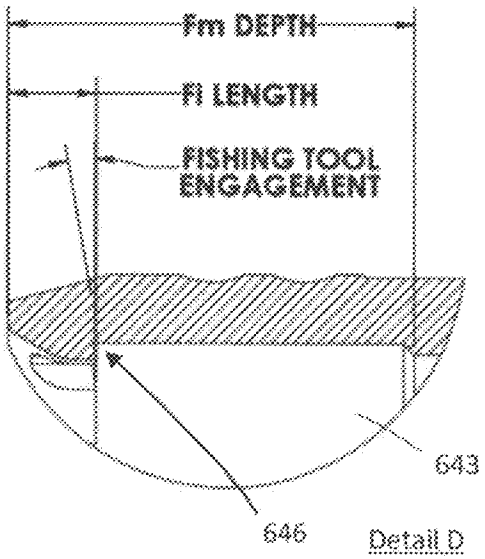
FIG. 6E is a close-up of a portion of FIG. 6D along circular portion D of FIG. 6D.
Figures 6F, 6G, 6H, 6J, 6K:
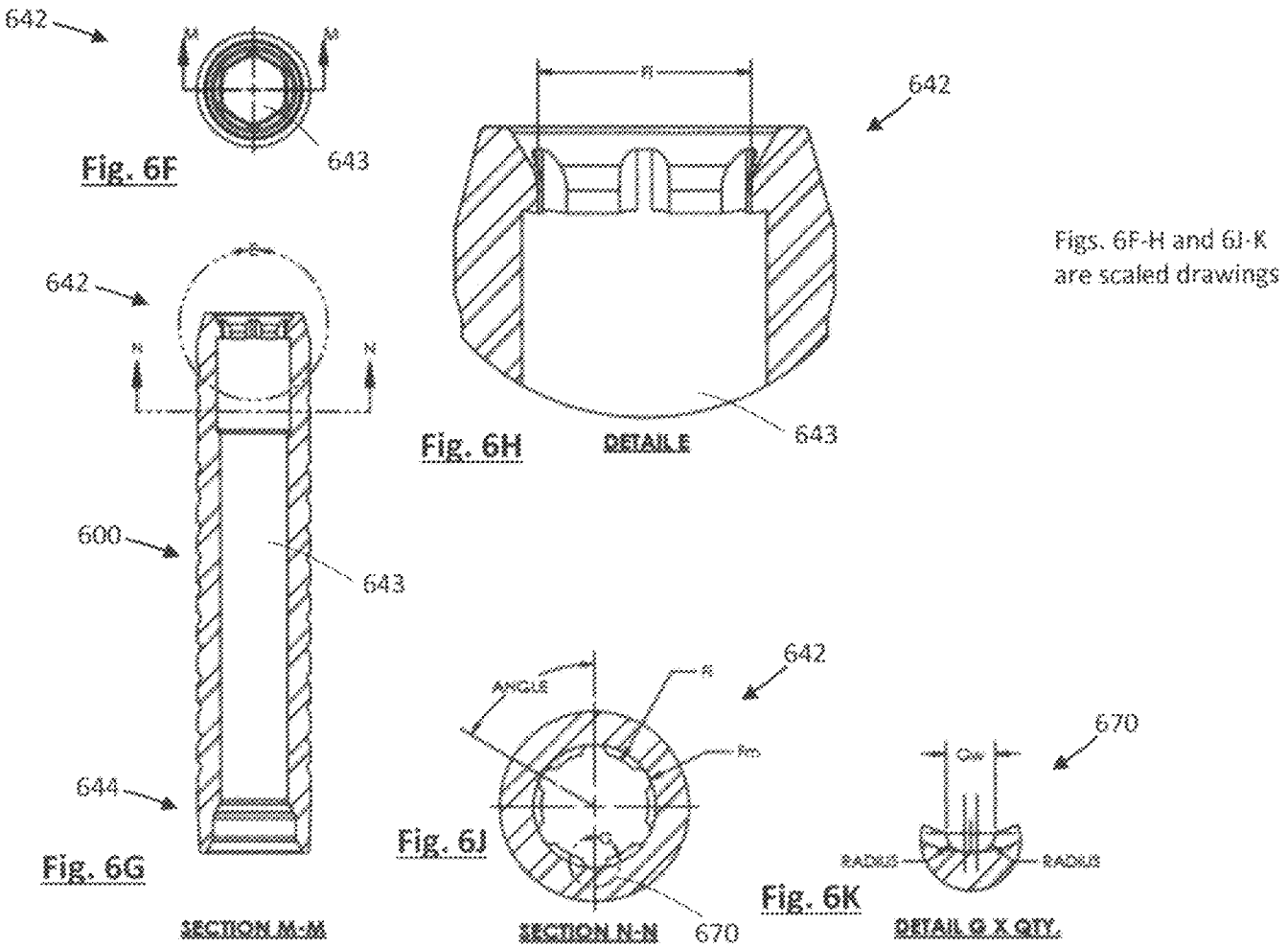
FIG. 6F is a top view of the bypass plunger fitted with an enhanced geometry receiving element of FIG. 6A.
FIG. 6G is a cut-away side view of the bypass plunger fitted with an enhanced geometry receiving element of FIG. 6A.
FIG. 6H is a close-up of a portion of FIG. 6G along circular portion E of FIG. 6G.
FIG. 6J is a cut-away top view of the bypass plunger along line N-N of FIG. 6G.
FIG. 6K is a close-up of a portion of FIG. 6J along circular portion G of FIG. 6J.

FIG. 6A provides a perspective view of another embodiment of a bypass plunger 600 fitted with an enhanced geometry receiving element. FIG. 6B provides a side view of the bypass plunger 600, and FIG. 6C provides a top view of the bypass plunger 600. FIG. 6D provides a cut-away side view of the bypass plunger 600. FIG. 6E is a close-up of a portion of FIG. 6D along circular portion D of FIG. 6D. FIG. 6F provides a top view of the bypass plunger 600 as fitted with an enhanced geometry receiving element, and FIG. 6G provides a cut-away side view of the bypass plunger 600. FIG. 6H is a detail or close-up view of portion E of FIG. 6G. FIG. 6J is a cut-away top view along line or cut N-N of FIG. 6G. Lastly, FIG. 6K is a detail or close-up of a portion of FIG. 6J along circular portion G of FIG. 6J.

Simulation and/or testing results have generated comparisons between an increase in cross sectional area at an interior lip of a fishing neck with an increase in plunger fall rate. It should be noted that there is an upper limit to the amount of increase in fishing neck area at the interior lip if the fishing neck is required to engage a conventional inside grappling fishing tool.

Each of the above described embodiments of the enhanced geometry receiving element, as adapted for or fitted to a conventional interior fishing neck of a downhole tool such as a bypass plunger, result in an increase in plunger fall rate due to a reduction in interior flow disruption at or near the interior fishing neck region. Embodiments of the enhanced geometry receiving element may be described with respect to the cross-sectional groove profile (e.g. shape, number of grooves, etc.). An alternate and complementary way to describe the enhanced geometry receiving element would be to describe the relative amount of "cut-out" or removal of the lip portion that makes up the catch or ledge portion of the fishing neck, given that the lip portion is the portion of the fishing neck that causes the flow disruption and the associated increased plunger drag and decrease in plunder descent speed. Such a removal of a portion of the disruptive lip portion translates to an increase in cross-sectional flow area.

Furthermore, an additional or alternative way to characterize the set of axial grooves is by the change in perimeter of the nominal flow through area C. For example, the nominal perimeter Pnom of the flow through area C is the circumference of the circle (where circumference is calculated as $\pi$ times circle diameter) that defines the area C. If each groove has a groove profile Gp, an outer perimeter S, and groove width Gw 351, then each groove provides an increase in the perimeter of the flow through area of approximately (S−Gw). Thus, in the configuration of FIG. 3A-C for example, the new (and increased) perimeter Pnew created by the presence of the six grooves is: $(\pi F_i+6(S-Gw))$. A graph of the perimeter increase (of 6(S−Gw)) with fall rate would yield increased fall rates with perimeter increase.

Note that the ratio of Pnew to Pnom may be used to define embodiments that produce the same or similar performance in plunger fall rate. For example, for a plunger of Fm=1.230 inch and Fi=1.070 inch, a Pnom=3.362 inch; in one embodiment, Pnew=4.004 inch and thus a ratio Pnew/Pnom of 1.190 may be calculated. In one embodiment, the ratio Pnew/Pnom is about 1.190.

In one embodiment, the ratio Pnew/Pnom is between 1.0 and 1.3. In a more preferred embodiment, the ratio Pnew/Pnom is between 1.06 and 1.26. In a most preferred embodiment, the ratio A/C is between 1.10 and 1.20.

In one embodiment, the ratio Pnew/Pnom is between 1.01 and 1.5.

FIGS. 7-11 depict additional embodiments of an enhanced geometry receiving element as fitted to a bypass plunger with an otherwise conventional interior fishing neck. Stated another way, FIGS. 7-11 depict additional embodiments of a grooved fishing neck downhole tool 700, 800, 900, 1000, and 1100 comprising an enhanced geometry receiving element (aka a grooved receiving element). Each of the grooved fishing neck downhole tool 700, 800, 900, 1000, and 1100 may, respectively, be referred to as simply a bypass plunger 700, 800, 900, 1000, and 1100.

Figure 7A:
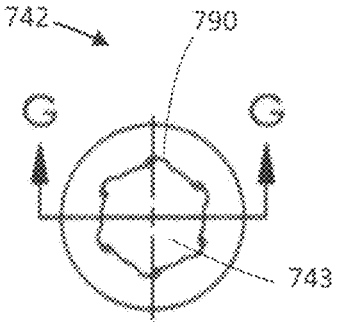
FIG. 7A is a top view of another embodiment of a bypass plunger fitted with an enhanced geometry receiving element with rifled axial grooves.
Figure 7B:
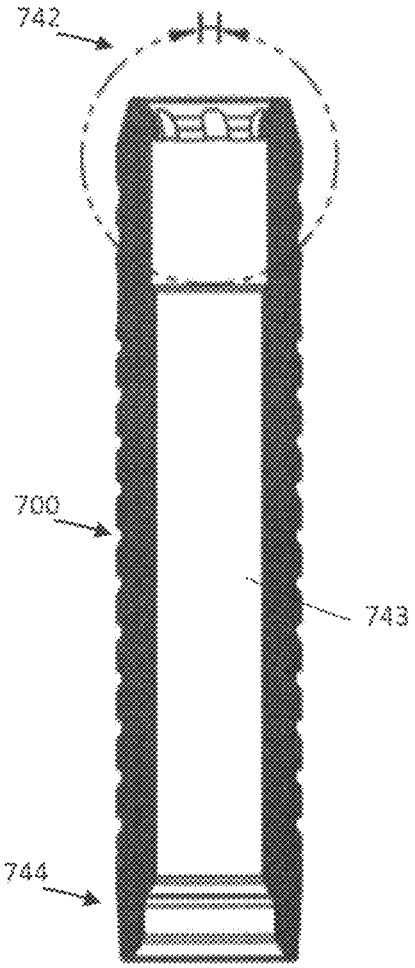
FIG. 7B is a cut-away side view of the bypass plunger fitted with an enhanced geometry receiving element of FIG. 7A, the cut-away taken along line G-G of FIG. 7A.
Figure 7C:
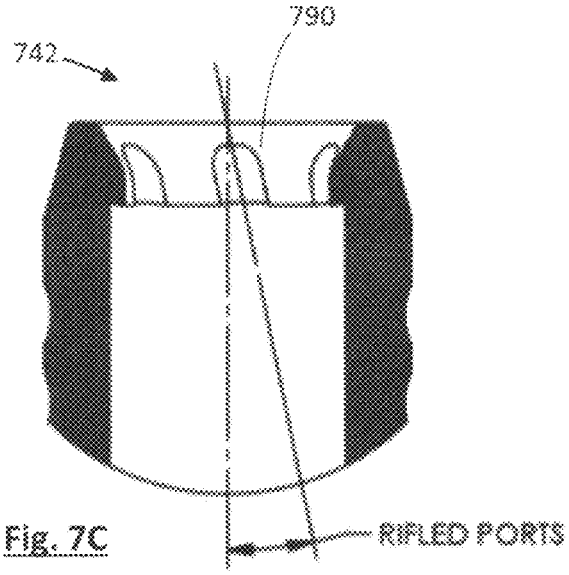
FIG. 7C is a close-up of a portion of FIG. 7B along circular portion H of FIG. 7B.
Figure 7D:
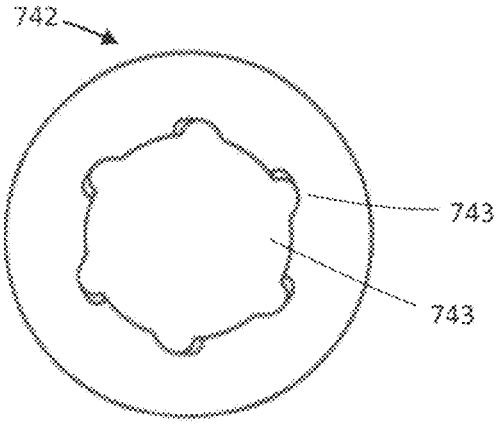
FIG. 7D is a close-up of FIG. 7A.

FIGS. 7A-D depict a rifled port (or rifled grove) embodiment 700 of an enhanced geometry receiving element. FIGS. 7A and 7B depict, respectfully, a top view and a cross sectional front view of the rifled port embodiment 700 of a bypass plunger with upper portion 742, lower portion 744, interior 743, and a set of six rifled ports 790. FIG. 7C is a detail of section H of FIG. 7B, and FIG. 7D is a top view of FIG. 10C (which also provides a close-up view of FIG. 7A). Each of the six rifled ports 790 are, at a given axial cross section, similar to the rounded corner configuration of FIGS. 3A-C, yet twist, or rifle, along the axial length. In the embodiment shown, each of the rifled ports twist in a clockwise manner when viewed from above meaning when viewed looking into the plunger from the upper portion 742. In another configuration, the ports are rifled in a counter-clockwise manner. Each of the six ports are of uniform depth and width with respect to the axial direction. The rifled configuration urges or causes the plunger to rotate in an along the center axis when descending into a tubular string.

FIGS. 8A-D and FIGS. 9A-D depict, respectively, a radially diverging port (or groove) embodiment 800 and a radially converging port (or groove) embodiment 900 of a bypass plunger. Each of these embodiments comprise six axial grooves in the fishing neck interior.

Figure 8A:
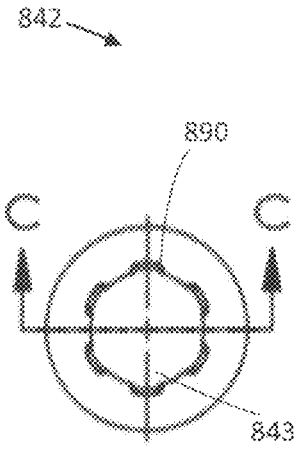
FIG. 8A is a top view of another embodiment of a bypass plunger fitted with an enhanced geometry receiving element with radially diverging axial grooves.
Figure 8C:
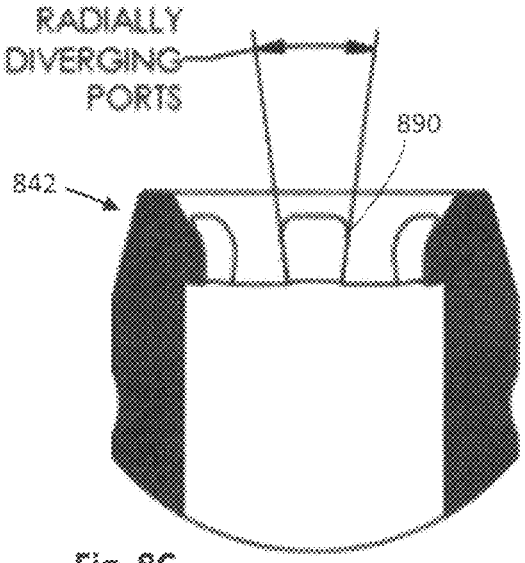
FIG. 8C is a close-up of a portion of FIG. 8B along circular portion D of FIG. 8B.
Figure 8B:
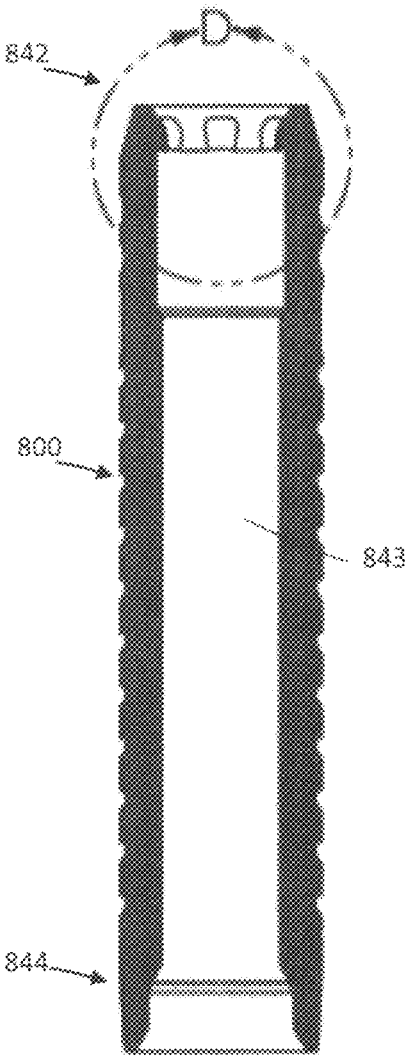
FIG. 8B is a cut-away side view of the bypass plunger fitted with an enhanced geometry receiving element of FIG. 8A, the cut-away taken along line C-C of FIG. 8A.
Figure 8D:
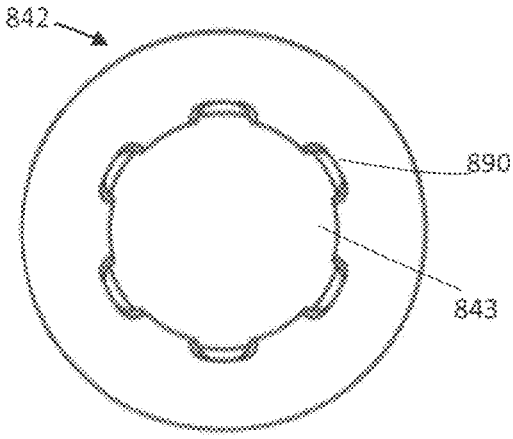
FIG. 8D is a close-up of FIG. 8A.

FIGS. 8A and 8B depict a top view and a cross sectional front view of the radially diverging embodiment 800 of a bypass plunger with upper portion 842, lower portion 844, interior 843, and a set of six radially diverging grooves 890. FIG. 8C is a detail of section D of FIG. 8B, and FIG. 8D is a top view of FIG. 8C. Each of the six radially diverging grooves 890 are similar to the rounded corner configuration of FIGS. 3A-C yet expand or widen in width along the axial length. Each of the six ports are of uniform depth but either expand or diverge in width from the from the lip area of the fishing neck toward the uppermost area of the plunger.

Figure 9A:
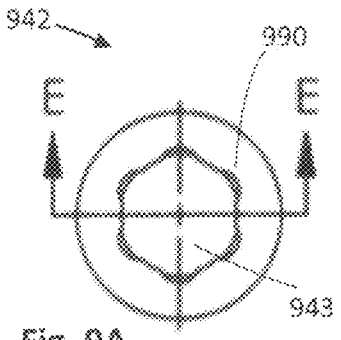
FIG. 9A is a top view of another embodiment of a bypass plunger fitted with an enhanced geometry receiving element with radially converging axial grooves.
Figure 9B:
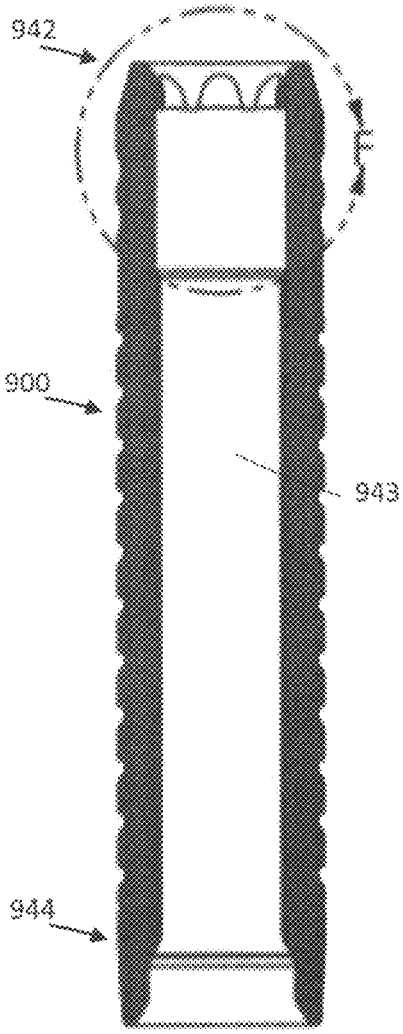
FIG. 9B is a cut-away side view of the bypass plunger fitted with an enhanced geometry receiving element of FIG. 8A, the cut-away taken along line E-E of FIG. 9A.
Figure 9C:
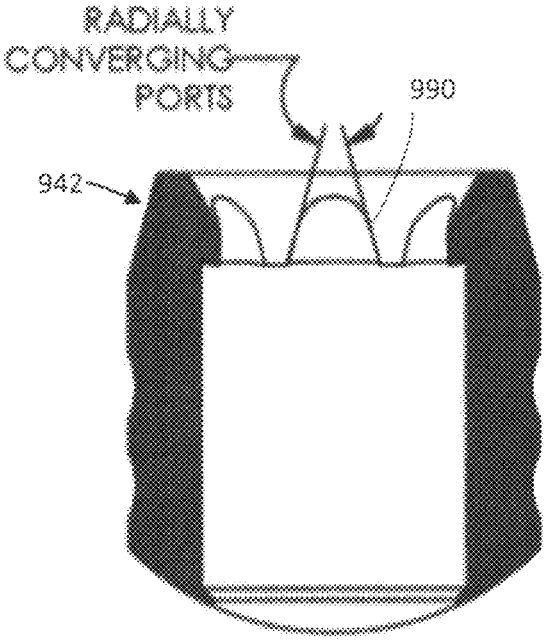
FIG. 9C is a close-up of a portion of FIG. 9B along circular portion F of FIG. 9B.
Figure 9D:
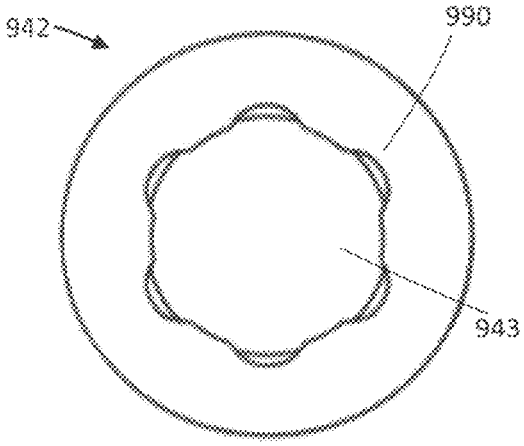
FIG. 9D is a close-up of FIG. 9A.

FIGS. 9A and 9B depict a top view and a cross sectional front view of the radially converging embodiment 900 of a bypass plunger with upper portion 942, lower portion 944, interior 943, and a set of six radially converging grooves 990. FIG. 9C is a detail of section F of FIG. 9B, and FIG. 9D is a top view of FIG. 9C. Each of the six radially converging grooves 990 are similar to the rounded corner configuration of FIGS. 3A-C yet converge or narrow in width along the axial length. Each of the six ports are of uniform depth but contract or converge in width from the from the lip area of the fishing neck toward the uppermost area of the plunger.

FIGS. 10A-D and FIGS. 11A-D depict, respectively, an axially converging port (or groove) embodiment 1000 and an axially diverging port (or groove) embodiment 1100 of a bypass plunger. Each of these embodiments comprise six axial grooves in the fishing neck interior.

Figure 10A:
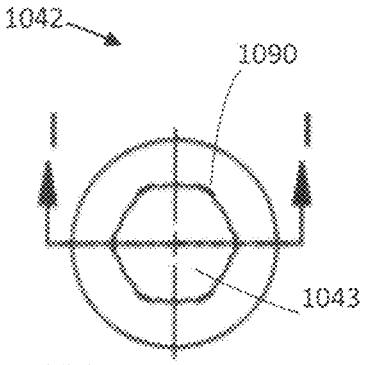
FIG. 10A is a top view of another embodiment of a bypass plunger fitted with an enhanced geometry receiving element with radially converging axial grooves.
Figure 10B:
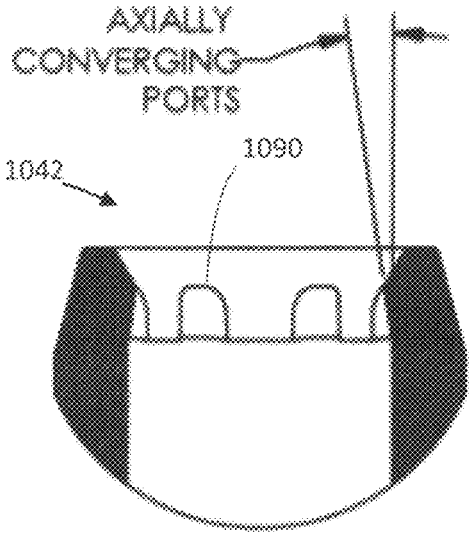
FIG. 10B is a cut-away side view of the bypass plunger fitted with an enhanced geometry receiving element of FIG. 10A, the cut-away taken along line I-I of FIG. 10A.
Figure 10B:
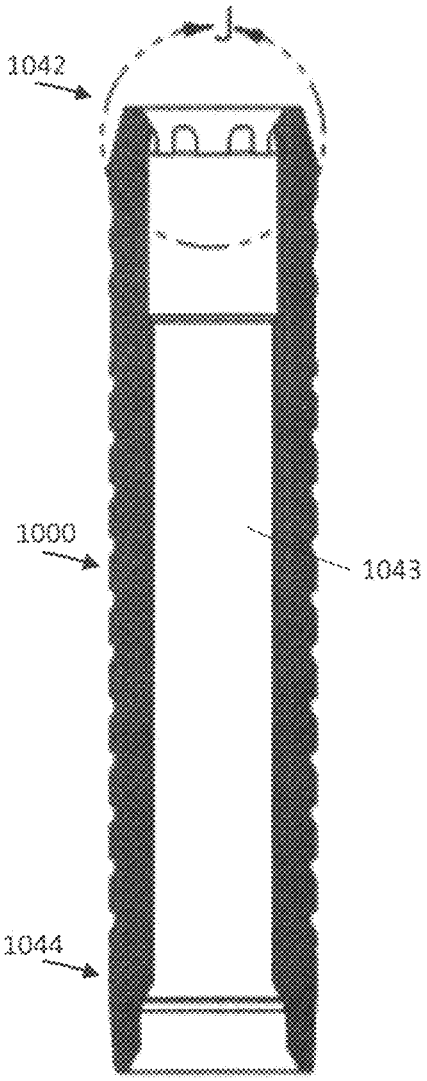
Figure 10D:
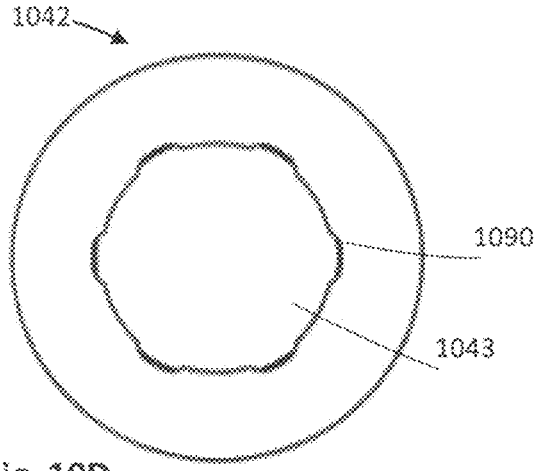
FIG. 10D is a close-up of FIG. 10A.

FIGS. 10A and 10B depict a top view and a cross sectional front view of the axially converging embodiment 1300 of a bypass plunger with upper portion 1042, lower portion 1044, interior 1043, and a set of six radially converging grooves 1090. FIG. 10C is a detail of section J of FIG. 10B, and FIG. 10D is a top view of FIG. 10C. Each of the six radially converging grooves 1090 are similar to the rounded corner configuration of FIGS. 3A-C yet decrease in depth along the axial length as fluid travels from the plunger interior and out the fishing neck. Each of the six ports are of uniform width along the axial length but decrease in depth (relative to the interior) from the lip area of the fishing neck moving toward the uppermost area of the plunger.

Figure 11A:
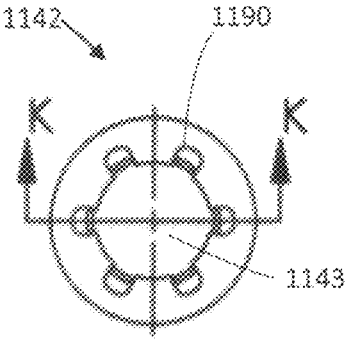
FIG. 11A is a top view of another embodiment of a bypass plunger fitted with an enhanced geometry receiving element with radially diverging axial grooves.
Figure 11C:
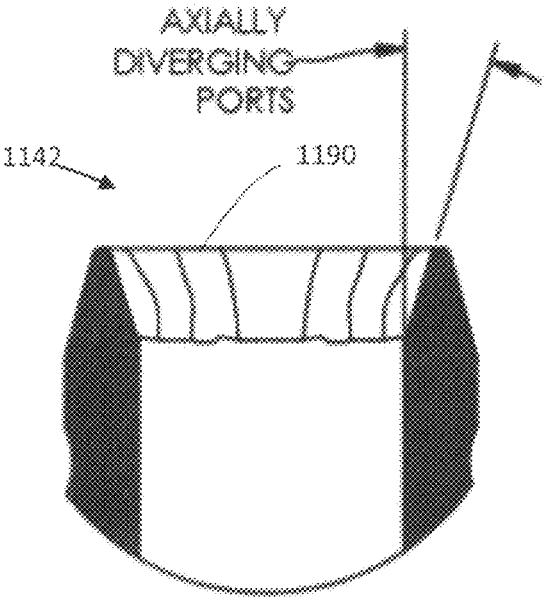
FIG. 11C is a close-up of a portion of FIG. 10B along circular portion L of FIG. 11B.
Figure 11B:
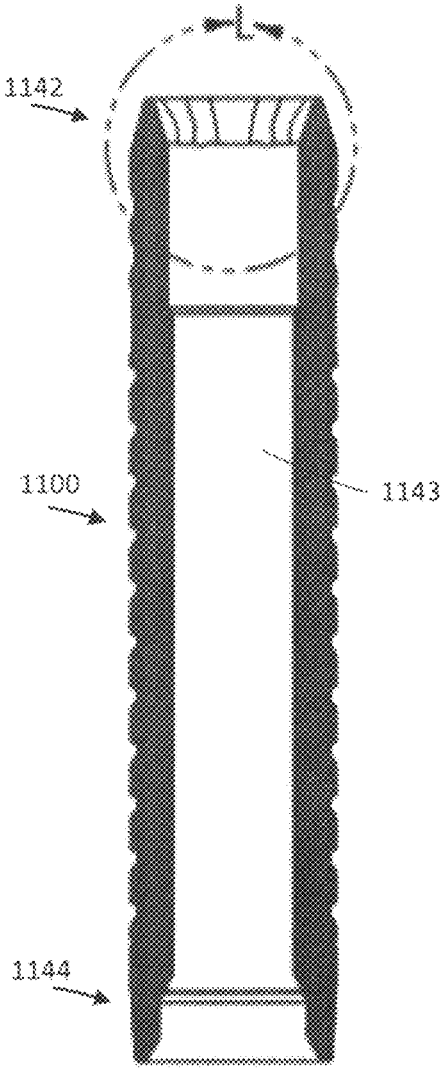
FIG. 11B is a cut-away side view of the bypass plunger fitted with an enhanced geometry receiving element of FIG. 11A, the cut-away taken along line K-K of FIG. 11A.
Figure 11D:
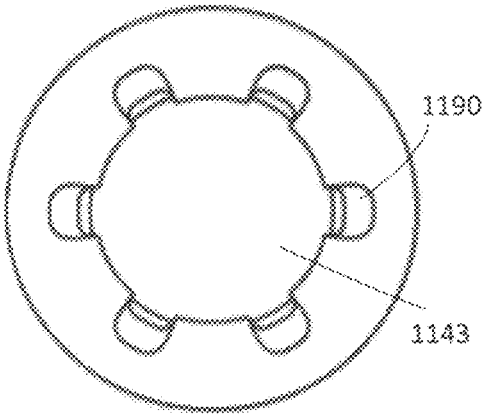
FIG. 11D is a close-up of FIG. 11A.

FIGS. 11A and 11B depict a top view and a cross sectional front view of the axially diverging embodiment 1100 of a bypass plunger with upper portion 1142, lower portion 1144, interior 1143, and a set of six radially diverging grooves 1190. FIG. 11C is a detail of section L of FIG. 11B, and FIG. 11D is a top view of FIG. 11C. Each of the six radially diverging grooves 1190 are similar to the rounded corner configuration of FIGS. 3A-C yet increase in depth along the axial length as fluid travels from the plunger interior and out the fishing neck. Each of the six ports are of uniform width along the axial length but increase in depth (relative to the interior) from the lip area of the fishing neck moving toward the uppermost area of the plunger.

As with all of the embodiments in the disclosure, features or elements of any embodiment may be combined with other embodiments. For example, the rifled port embodiment of FIGS. 7A-D may be combined with the radially diverging port embodiment of FIGS. 8A-D.

Note that in some embodiments, the axial distance of one or more of the grooves is substantially the entire distance between the interior fishing neck lip and the end of the plunger. In some embodiments, the axial distance of one or more of the grooves is less than the entire distance between the interior fishing neck lip and the end of the plunger.

Figure 12:
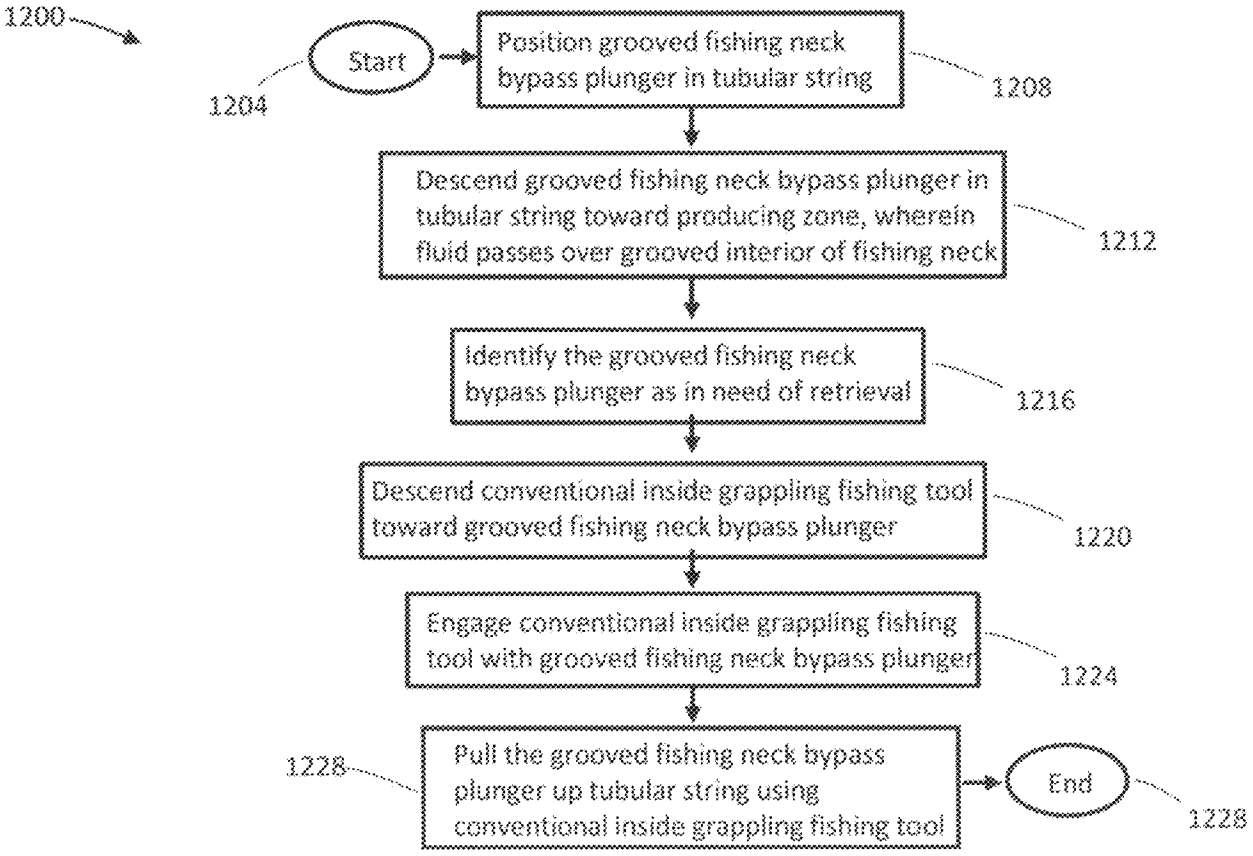
FIG. 12 depicts a flowchart of a method of use of a bypass plunger configured with an enhanced geometry receiving element.

FIG. 12 depicts a flowchart of a method of use 1200 of a grooved fishing neck downhole tool, such as a grooved fishing neck bypass plunger downhole tool, configured with an enhanced geometry receiving element of the type described with respect to FIGS. 3-11. The method of use of FIG. 12 will be described with reference to elements of the previous FIGS. 1-11. Note that although the method 1200 is presented with respect to a bypass plunger downhole tool, the method 1200 may be used with any downhole tool fitted with an enhanced geometry receiving element of the type described with respect to FIGS. 3-11. Note that the grooved fishing neck bypass plunger downhole tool may be referred to as a grooved fishing neck bypass plunger and/or a grooved fishing neck interior flow through plunger.

The flowchart or process diagram of FIG. 12 starts at step 1204 and ends at step 1232. Any of the steps, functions, and operations discussed herein can be performed continuously and automatically. The steps are notionally followed in increasing numerical sequence, although, in some embodiments, some steps may be omitted, some steps added, and the steps may follow other than increasing numerical order.

After starting at step 1204, the method 1200 proceeds to step 1208 wherein a grooved fishing neck bypass plunger is positioned in a tubular string of a wellbore. The grooved fishing neck bypass plunger is of the type descried above and is configured to engage a conventional inside grappling fishing tool at an upper end of the bypass plunger. After completing step 1208, the method 1200 proceeds to step 1212.

At step 1212, the grooved fishing neck bypass plunger is allowed to descend or to fall downward into the wellbore or toward the producing end of the tubular string. During the descent, at least some fluid contained in the tubular string enters a lower end of the grooved fishing neck bypass plunger, passes through an interior of the grooved fishing neck bypass plunger, passes over a grooved interior neck portion of the grooved fishing neck bypass plunger, and exits from the upper end of the grooved fishing neck bypass plunger. After completing step 1212, the method 1200 proceeds to step 1216.

At step 1216, the grooved fishing neck bypass plunger is stopped or is generally stationary within the tubular string, such as stopped at or near the bottom of the tubular string or is generally identified as in need of retrieval from a location within the tubular string. After completing step 1216, the method 1200 proceeds to step 1220.

At step 1220, a conventional inside grappling fishing tool or interior fitting fishing tool is descended into the tubular string toward the grooved fishing neck bypass plunger. After completing step 1220, the method 1200 proceeds to step 1224.

At step 1224, the conventional inside grappling fishing tool engages the grooved fishing neck bypass plunger at or adjacent the grooved fishing neck portion of the grooved fishing neck plunger. The conventional inside grappling fishing tool fits within the grooved fishing neck portion of the grooved fishing neck plunger so as to allow the conventional inside grappling fishing tool to impart an upward force to the grooved fishing neck bypass plunger. After completing step 1224, the method 1200 proceeds to step 1228.

At step 1228, the conventional inside grappling fishing tool pulls the grooved fishing neck bypass plunger away from the producing zone and toward the surface, so as to retrieve the grooved fishing neck bypass plunger. After completing step 1228, the method 1200 ends at step 1232.

In some embodiments, the grooves of the grooved fishing neck portion are milled where the center axis on geometry is parallel to the centerline axis (the ID/OD) of the plunger.

In a one embodiment, the grooves of the grooved fishing neck interior flow through plunger realize an increase in fall speed of at least 50% increase in fall speed relative to the same bypass plunger without grooves in the fishing neck, while maintaining the ability for the bypass plunger to be retrieved using conventional inside grappling fishing tools. In another embodiment, the grooves of the grooved fishing neck interior flow through plunger realize at least an increase in fall speed of at least 5%. In another embodiment, the grooves of the grooved fishing neck interior flow through plunger realize at least an increase in fall speed of at least 10%. In one embodiment, the grooves of the grooved fishing neck interior flow through plunger realize an increase in fall speed between 0.1% and 50%.

In some embodiments, the grooved fishing neck is configured to engage with any commercially available interior fishing tool, such as any interior fishing tools known to those skilled in the art or defined by standards or trade groups, such as the American Petroleum Institute, to include, without limitation, interior fishing tools other than conventional inside grappling fishing tools.

What is claimed is:

1. A grooved receiving device forming a portion of a downhole tool, comprising:

a cylindrical body having an interior surface defining a cavity, the cylindrical body having a longitudinal axis and forming an upper portion of the downhole tool, the interior surface having a first diameter and comprising a plurality of axial grooves; wherein:

the cavity is configured to pass a fluid received from an interior of the downhole tool;

each of the plurality of axial grooves define a depth that extends radially into the interior surface to a second diameter, the second diameter greater than the first diameter; and each of the plurality of axial grooves define a width spanning between a first interior surface radius and a second interior surface radius, the width extending to an axial groove length along the longitudinal axis.

2. The device of claim 1, wherein the grooved receiving device is configured to receive a conventional inside grappling fishing tool.

3. The device of claim 2, wherein the downhole tool is an interior flow through plunger tool configured for use in a hydrocarbon wellbore.

4. The device of claim 1, wherein the width of each of the axial grooves is no more than 0.75 inch.

5. The device of claim 1, wherein the axial grooves are concentric about the longitudinal axis.

6. The device of claim 1, wherein each of the axial grooves extend axially along and into the interior surface to a first length.

7. The device of claim 6, wherein the second diameter is constant along the first length.

8. The device of claim 6, wherein the second diameter is variable along the first length.

9. The device of claim 1, wherein the plurality of axial grooves are rifled axial grooves.

10. The device of claim 1, wherein the plurality of axial grooves are two or more axial grooves.

11. The device of claim 1, wherein:

the first diameter defines a nominal inner diameter cross-sectional area of the upper portion of the downhole tool;

the plurality of axial grooves extending radially into the interior surface define an enhanced geometry inner diameter cross-sectional area of the upper portion of the downhole tool; and the ratio of the enhanced geometry inner diameter cross-sectional area to the nominal inner diameter cross-sectional area is between 1.01 and 1.40.

12. The device of claim 1, wherein:

the first diameter defines a nominal perimeter of the upper portion of the downhole tool;

the plurality of axial grooves extending radially into the interior surface define a grooved perimeter of the upper portion of the downhole tool; and the ratio of the grooved perimeter to the nominal perimeter is between 1.01 and 1.5.

13. A grooved receiving device forming a portion of a downhole tool, comprising:

an interior surface defining a cavity of the grooved receiving device, the grooved receiving device having a longitudinal axis, the interior surface comprising a plurality of axial grooves and the cavity having a nominal first diameter, the interior surface coupled to a downhole tool interior surface; wherein:

the cavity is configured to pass a fluid received from an interior cavity of the downhole tool;

each of the plurality of axial groves define a depth that extends radially into the interior surface from the nominal first diameter to a second diameter, the second diameter greater than the nominal first diameter; and each of the plurality of axial grooves define a width spanning between a first interior surface radius and a second interior surface radius, the width extending to an axial groove length along the longitudinal axis.

14. The device of claim 13, wherein the downhole tool device is an interior flow through plunger.

15. The device of claim 13, wherein each of the set of axial grooves extend axially to a first length and are concentric about the longitudinal axis.

16. The device of claim 13, wherein the device forms a fishing neck adapted to receive a conventional inside grappling fishing tool.

17. The device of claim 11, wherein the plurality of axial grooves are three or more axial grooves.

18. The device of claim 11, wherein the width of each of the axial grooves varies along the longitudinal axis.

19. A method of descending and retrieving a grooved fishing neck downhole tool within a tubular string of a wellbore, comprising:

positioning the grooved fishing neck downhole tool within the tubular string, the grooved fishing neck downhole tool comprising:

a cylindrical body adapted to fit within the tubular string, the cylindrical body having a longitudinal axis and having a body interior surface defining a cavity of a first diameter, the cavity adapted to pass a fluid from the cavity and out an upper portion of the cylindrical body; and a set of axial grooves disposed on the body interior surface at the upper portion, each of the set of axial grooves extending radially to a first depth and defining a second diameter, each of the set of axial grooves defining a width spanning between a first body interior surface radius and a second body interior surface radius, the width extending to an axial groove length along the longitudinal axis;

descending the grooved fishing neck downhole tool within the tubular string to a fixed location, wherein fluid passes through the set of axial grooves;

lowering a conventional inside grappling fishing tool toward the grooved fishing neck downhole tool;

engaging the conventional inside grappling fishing tool with at least a portion of the grooved fishing neck downhole tool adjacent the set of axial grooves; and pulling the conventional inside grappling fishing tool up the tubular string so as to retrieve the grooved fishing neck downhole tool.

20. The method of claim 19, wherein the grooved fishing neck downhole tool is a grooved fishing neck interior flow through plunger.

* * * * *